US012745889B2

(12) United States Patent
Ohm et al.

(10) Patent No.: US 12,745,889 B2
(45) Date of Patent: Sep. 29, 2026

(54) PAD WASHING DOCK FOR MOBILE CLEANING ROBOTS

(71) Applicant: iRobot Corporation, Bedford, MA (US)

(72) Inventors: Timothy R. Ohm, Grover Beach, CA (US); Travis Gschrey, Billerica, MA (US); Douglas Dell'Accio, Boston, MA (US); Winston Heinrichs, Brighton, MA (US); Eleanor Foltan, Nashua, NH (US); Eric Wallace, Andover, MA (US)

(73) Assignee: iRobot Corporation, Bedford, MA (US)

( * ) Notice: Subject to any disclaimer, the term of this patent is extended or adjusted under 35 U.S.C. 154(b) by 648 days.

(21) Appl. No.: 18/106,078

(22) Filed: Feb. 6, 2023

(65) Prior Publication Data

US 2024/0260807 A1 Aug. 8, 2024

(51) Int. Cl.

| | |
|---|---|
| ***A47L 11/40*** | (2006.01) |
| ***A47L 9/00*** | (2006.01) |
| ***A47L 9/14*** | (2006.01) |
| ***A47L 9/28*** | (2006.01) |

(52) U.S. Cl.

CPC ..... *A47L 11/4091* (2013.01); *A47L 9/0063* (2013.01); *A47L 9/149* (2013.01); *A47L 9/2873* (2013.01); *A47L 11/4025* (2013.01); *A47L 2201/024* (2013.01); *A47L 2201/028* (2013.01)

(58) Field of Classification Search

CPC .. A47L 11/4091; A47L 9/0009; A47L 9/0063; A47L 9/2873; A47L 9/149; A47L 2201/02; A47L 2201/024; A47L 2201/028

See application file for complete search history.

(56) References Cited

U.S. PATENT DOCUMENTS

| | | | | |
|---|---|---|---|---|
| 7,891,387 | B2 | 2/2011 | Lim et al. | |
| 9,462,920 | B1 | 10/2016 | Morin et al. | |
| 10,786,129 | B1 | 9/2020 | Ebrahimi Afrouzi et al. | |
| 10,986,971 | B1 | 4/2021 | Ebrahimi Afrouzi | |
| 2018/0116478 | A1* | 5/2018 | Lewis | A47L 9/009 |

(Continued)

FOREIGN PATENT DOCUMENTS

| | | | | |
|---|---|---|---|---|
| CA | 3123772 | A1 * | 12/2019 | A47L 11/4094 |
| CN | 211749314 | | 10/2020 | |

(Continued)

OTHER PUBLICATIONS

"U.S. Appl. No. 17/748,361, Examiner Interview Summary mailed Dec. 31, 2024", 2 pgs.

(Continued)

*Primary Examiner* — C. A. Rivera
(74) *Attorney, Agent, or Firm* — MASCHOFF BRENNAN

(57) ABSTRACT

A docking station for a mobile cleaning robot can include a base, a housing, and a pad cleaning system. The base can be configured to receive the mobile cleaning robot. The housing can be connected to the base. The pad cleaning system can be connected to the housing and can include a reservoir configured to retain liquid therein. The pad cleaning system can also include an agitator located at least partially within the reservoir. The agitator can be engageable with a cleaning pad of the mobile cleaning robot.

15 Claims, 24 Drawing Sheets

(56) References Cited

U.S. PATENT DOCUMENTS

| | | | | |
|---|---|---|---|---|
| 2020/0000305 | A1 | 1/2020 | Fox et al. | |
| 2021/0369072 | A1 | 12/2021 | Gao | |
| 2022/0400925 | A1* | 12/2022 | Hoobler | A47L 11/28 |

FOREIGN PATENT DOCUMENTS

| | | |
|---|---|---|
| CN | 112869673 | 6/2021 |
| CN | 218552245 | 3/2023 |
| CN | 218552248 | 3/2023 |
| CN | 218832686 | 4/2023 |
| EP | 2436296 | 4/2012 |
| EP | 3669738 | 6/2020 |
| WO | 2018108144 | 6/2018 |
| WO | 2022271354 | 12/2022 |
| WO | 2024167703 | 8/2024 |

OTHER PUBLICATIONS

"U.S. Appl. No. 17/748,361, Response filed Dec. 26, 2024 to Non-Responsive Amendment Received mailed Oct. 25, 2024", 8 pgs.
"U.S. Appl. No. 17/748,361, Final Office Action mailed Feb. 25, 2025", 11 pgs.
"U.S. Appl. No. 17/748,361, Response filed Aug. 15, 2024 to Non Final Office Action mailed May 16, 2024", 12 pgs.
"European Application Serial No. 22729961.7, Response filed Jul. 30, 2024 to Communication pursuant to Rules 161(1) and 162 EP", w claims, 16 pgs.
"U.S. Appl. No. 17/748,361, Non-Responsive Amendment Received mailed Oct. 25, 2024", 4 pgs.
"U.S. Appl. No. 17/748,361, Response filed Jun. 25, 2025 to Final Office Action mailed Feb. 25, 2025", 9 pgs.
"U.S. Appl. No. 17/748,361, Non Final Office Action mailed Jul. 2, 2025", 11 pgs.
"International Application Serial No. PCT US2024 013357, International Preliminary Report on Patentability mailed Aug. 21, 2025", 9 pgs.
"International Application Serial No. PCT US2022 030007, Invitation to Pay Additional Fees mailed Sep. 13, 2022", 13 pgs.
"International Application Serial No. PCT US2022 030007, International Search Report mailed Nov. 4, 2022", 6 pgs.
"International Application Serial No. PCT US2022 030007, Written Opinion mailed Nov. 4, 2022", 10 pgs.
"Chinese Application Serial No. 202221574553.4, Correction Notice mailed Nov. 10, 2022", w Concise Statement of Relevance, 2 pg.
"Chinese Application Serial No. 202221818095.4, Notification to Make Rectification mailed Nov. 10, 2022", w Concise Statement of Relevance, 2 pgs.
"Chinese Application Serial No. 202221574410.3, Correction Notice mailed Nov. 10, 2022", w Concise Statement of Relevance, 2 pg.
"Hoober, Rick, et al., Two in One Mobile Cleaning Robot, U.S. Appl. No. 63/088,544, filed Oct. 7, 2020", 45 pgs.
"Chinese Application Serial No. 202221574553.4, Response filed Jan. 19, 2023 to Correction Notice mailed Nov. 10, 2022", w English Claims, 26 pgs.
"Chinese Application Serial No. 202221818095.4, Response filed Jan. 19, 2023 to Notification to Make Rectification mailed Nov. 10, 2022", w Concise Statement of Relevance, 25 pgs.
"Chinese Application Serial No. 202221574410.3, Response filed Jan. 19, 2023 to Correction Notice mailed Nov. 10, 2022", w Concise Statement of Relevance, 25 pgs.
"European Application Serial No. 22729961.7, Communication Pursuant to Article 94(3) EPC mailed Sep. 19, 2025", 4 pgs.
"U.S. Appl. No. 17/748,361, Response filed Oct. 1, 2025 to Non Final Office Action mailed Jul. 2, 2025", 9 pgs.
"International Application Serial No. PCT US2022 030007, International Preliminary Report on Patentability mailed Jan. 4, 2024", 12 pgs.
"International Application Serial No. PCT US2024 013357, International Search Report mailed May 7, 2024", 3 pgs.
"International Application Serial No. PCT US2024 013357, Written Opinion mailed May 7, 2024", 7 pgs.
"U.S. Appl. No. 17/748,361, Non Final Office Action mailed May 16, 2024", 13 pgs.
"U.S. Appl. No. 17/748,361, Final Office Action mailed Oct. 17, 2025", 16 pgs.
"U.S. Appl. No. 17/748,361, Response filed Jan. 16, 2026 to Final Office Action mailed Oct. 17, 2025", 21 pgs.
"European Application Serial No. 22729961.7, Response filed Jan. 5, 2026 to Communication Pursuant to Article 943 EPC mailed Sep. 19, 2025", 57 pgs.
"U.S. Appl. No. 17/748,361, Non Final Office Action mailed Feb. 17, 2026", 5 pgs.
"U.S. Appl. No. 17/748,361, Response filed Mar. 16, 2026 to Non Final Office Action mailed Feb. 17, 2026", 9 pgs.

* cited by examiner

PAD WASHING DOCK FOR MOBILE CLEANING ROBOTS

BACKGROUND

Autonomous mobile robots include autonomous mobile cleaning robots that can autonomously perform cleaning tasks within an environment, such as a home. Many kinds of cleaning robots are autonomous to some degree and in different ways. Some robots can perform vacuuming operations and some can perform mopping operations. Other robots can include components or systems to perform both vacuuming and mopping operations. All types of mobile cleaning robots can interface with a docking station that can perform maintenance on the robot, such as charging and debris evacuation.

SUMMARY

Some autonomous cleaning robots can include both a vacuum system and a mopping system that can allow the robots to perform both mopping and vacuuming operations (such as simultaneously or alternatively), often referred to as two-in-one robots. Some two-in-one robots include a pad type mopping system located rearward of a vacuum extractor that allows the robot to extract debris from a floor surface just prior to mopping the surface with the pad. These systems can be effective for cleaning hard surfaces that may require both debris extraction and mopping. However, use of a pad type mopping system often requires that a cleaning pad be cleaned or replaced one or more times during a cleaning mission, depending on the size of the area to be cleaned and how dirty the area is. While a user can replace or clean the mopping pad of the mobile cleaning robot, a user interfacing with the mobile cleaning robot during missions can increase cleaning times and create more labor for the user.

This devices and methods of this disclosure help to address these issues by providing a mobile cleaning robot and docking station configured to autonomously clean or refresh a mopping pad of the mobile cleaning robot, before, during, or after a mopping mission. The mobile cleaning robot can navigate to the docking station and position a soiled or dirty cleaning pad into the docking station. The docking station can receive the mobile cleaning robot thereon and can clean the pad using an agitator, such as a rotating cleaner in a reservoir. The docking station can provide clean cleaning fluid to the reservoir and can collect dirty cleaning fluid from the reservoir following cleaning, such as using a blower configured to also perform debris evacuation from the robot. The docking station can also be configured to receive the mobile cleaning robot for pad drying, such that the docking station can work together with the robot to lift the cleaning pad tray and pad of the robot and discharge drying air over the pad to help reduce pad drying time. The docking station can include these and other features to help reduce user interactions with a mopping robot or a two-in-one mobile cleaning robot, helping to increase robot autonomy.

For example, a docking station for a mobile cleaning robot can include a base, a housing, and a pad cleaning system. The base can be configured to receive the mobile cleaning robot. The housing can be connected to the base. The pad cleaning system can be connected to the housing and can include a reservoir configured to retain liquid therein. The pad cleaning system can also include an agitator located at least partially within the reservoir. The agitator can be engageable with a cleaning pad of the mobile cleaning robot.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1B:
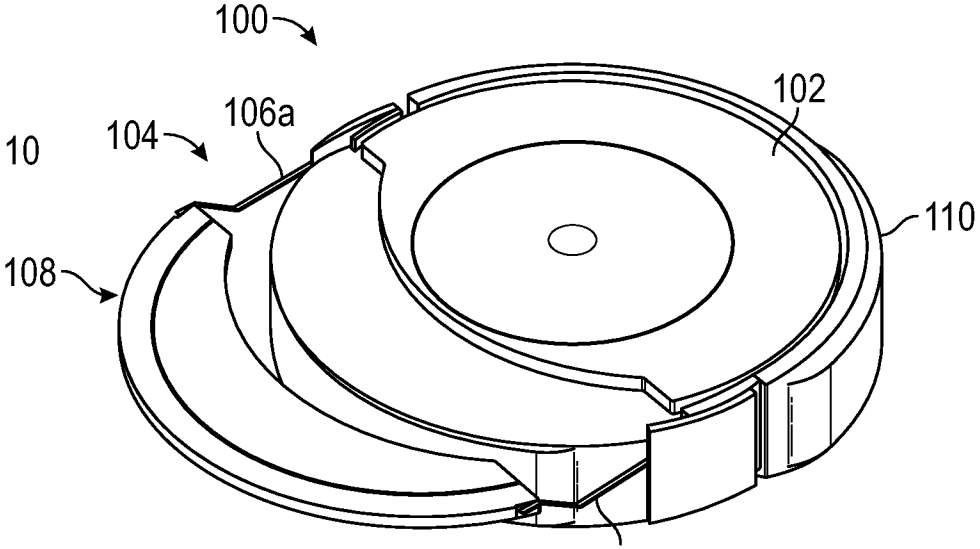
FIG. 1B illustrates an isometric view of a mobile cleaning robot in a second condition.
Figure 1A:
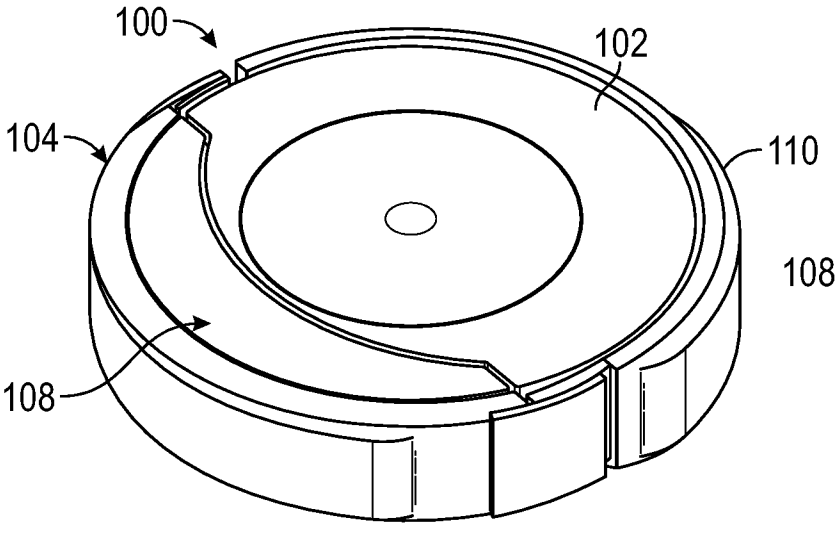
FIG. 1A illustrates an isometric view of a mobile cleaning robot in a first condition.
Figure 1C:
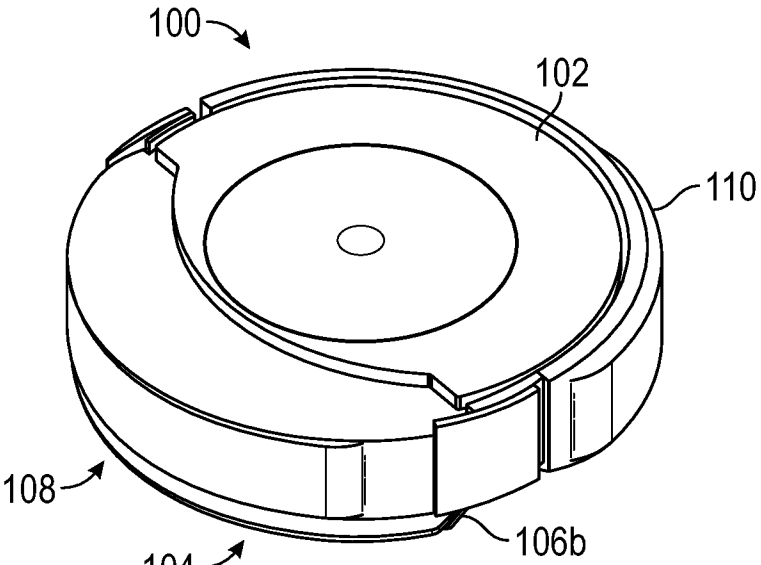
FIG. 1C illustrates an isometric view of a mobile cleaning robot in a third condition.

FIG. 1A illustrates an isometric view of a mobile cleaning robot 100 in a first condition. FIG. 1B illustrates an isometric view of the mobile cleaning robot 100 in a second condition. FIG. 1C illustrates an isometric view of the mobile cleaning robot 100 in a third condition. FIGS. 1A-1C are discussed together below.

The mobile cleaning robot 100 can include a body 102 and a mopping system 104. The mopping system 104 can include arms 106*a* and 106*b* (referred to together as arms 106) and a pad assembly 108. The robot 100 can also include a bumper 110 and other features such as an extractor (including rollers), one or more side brushes, a vacuum system, a controller, a drive system (e.g., motor, geartrain, and wheels), a caster, sensors, or the like, as shown in U.S. Patent Application Ser. No. 63/088,544, entitled "Two In One Mobile Cleaning Robot," filed on Oct. 7, 2020, to Michael G. Sack, which is incorporated by reference herein in its entirety. A proximal portion of the arms 106*a* and 106*b* can be connected to an internal drive system (such as shown and discussed in U.S. Patent Application Ser. No. 63/088,544). A distal portion of the arms 106 can be connected to the pad assembly 108.

In operation of some examples, the robot 100 can operate the arms 106 to move the pad assembly 108 between a stored position (shown in FIG. 1A), an extended position (shown in FIG. 1B), and an operating or cleaning position (shown in FIG. 1C). In the stored position, the robot 100 can perform vacuuming operations only. In the operating position, the robot 100 can perform wet or dry mopping operations and vacuuming operations or can perform only mopping operations. In the extended position (or other positions), the robot 100 can clean a pad 109 (shown in FIG. 4) of the pad assembly 108, as discussed in further detail below.

Figure 2:
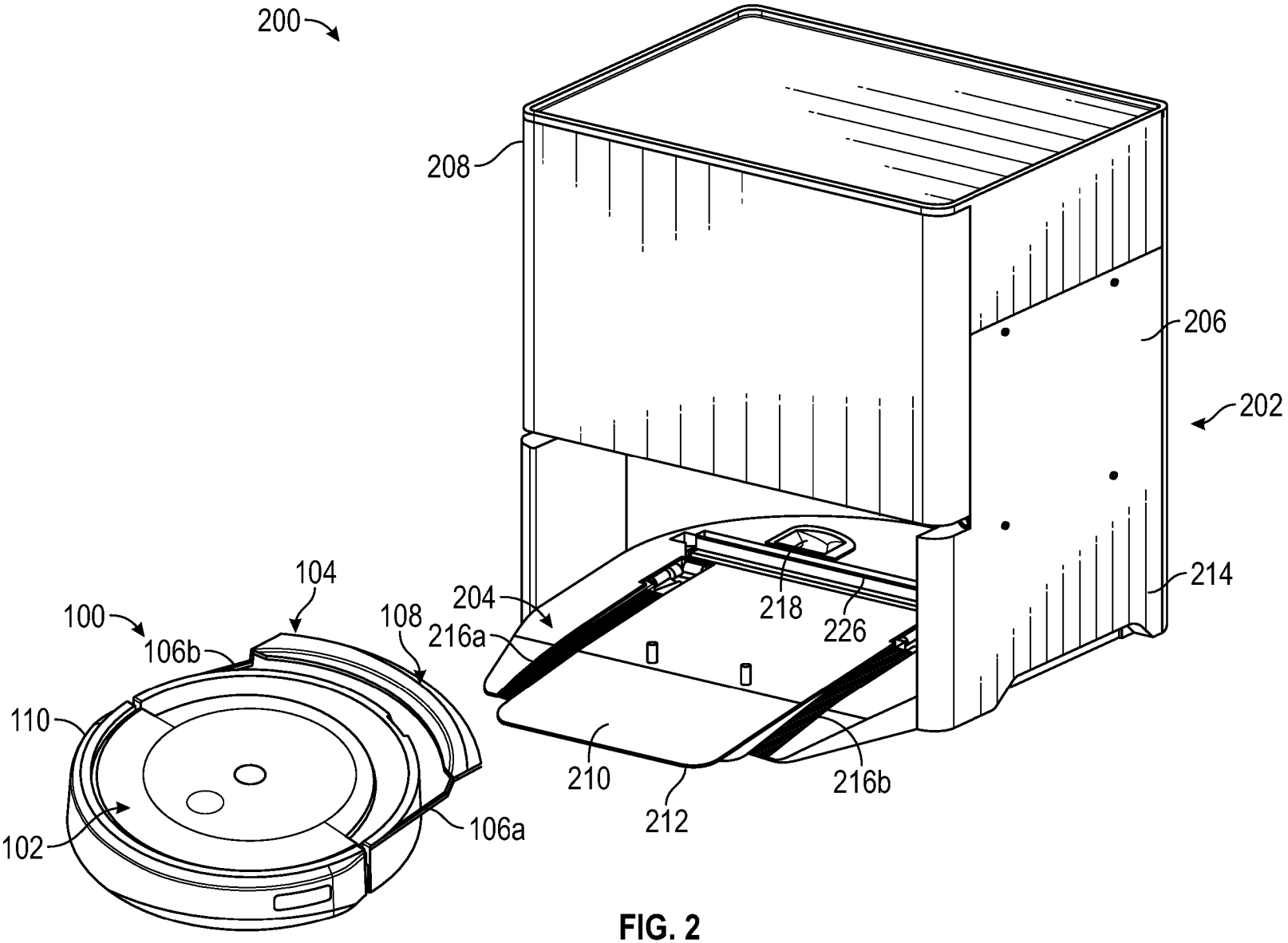
FIG. 2 illustrates an isometric view of a mobile cleaning robot and docking station.

FIG. 2 illustrates an isometric view of the mobile cleaning robot 100 and docking station 200. The docking station 200 can include a canister 202 and a base 204. The canister 202 can include an outer wall 206 and a cover 208. The base 204 can include a platform 210 having a front portion 212 and a rear portion 214. The base 204 can also include tracks 216*a* and 216*b* and a vacuum port 218.

The components of the docking station 200 can be rigid or semi-rigid components made of materials such as one or more of metals, plastics, foams, elastomers, ceramics, composites, combinations thereof, or the like. Materials of some components are discussed in further detail below. The base 204 can be a ramped member including the platform 210 and the tracks 216*a* and 216*b*, which can be configured to receive the mobile cleaning robot 100 thereon for maintenance, such as charging and emptying debris from the mobile cleaning robot. The tracks 216 can be configured to receive wheels of the robot 100 to guide the robot 100 onto the base 204 for charging and debris evacuation. The front portion 212 can be opposite the back portion 214, which can connect to the canister 202. The platform 210 and the tracks 216 can be sloped toward the front portion 212 to help allow the mobile robot 100 to dock on the station 200. The tracks 216 can include one or more features, projections, or textures to help increase traction between the platform 210 and wheels of the robot 100.

When the robot 100 is positioned on the base 204, such as when wheels of the robot 100 are in wheel wells or cradles of the tracks, the vacuum port 218 can be aligned with a vacuum outlet of the robot 100. The canister 202 can be an upper portion of the docking station 200 connected to the rear portion 214 of the base 204 and can extend upward therefrom. The outer wall 206 of the canister 202 can have a shape of a substantially rectangular hollow prism with rounded corners where the outer wall 206 can define a top portion of the canister 202 that is open. The cover 208 can be connected to the outer walls 206 (such as by hinges or other fasteners), such as at a side portion of the cover 208. The cover 208 can be releasably securable to the outer wall 206, such as at a side portion of the cover 208 and the outer wall 206 (such as via a friction/interference fit, latch, or the like). Any of the docking stations discussed below can include the features of the docking station 200.

Figure 3:
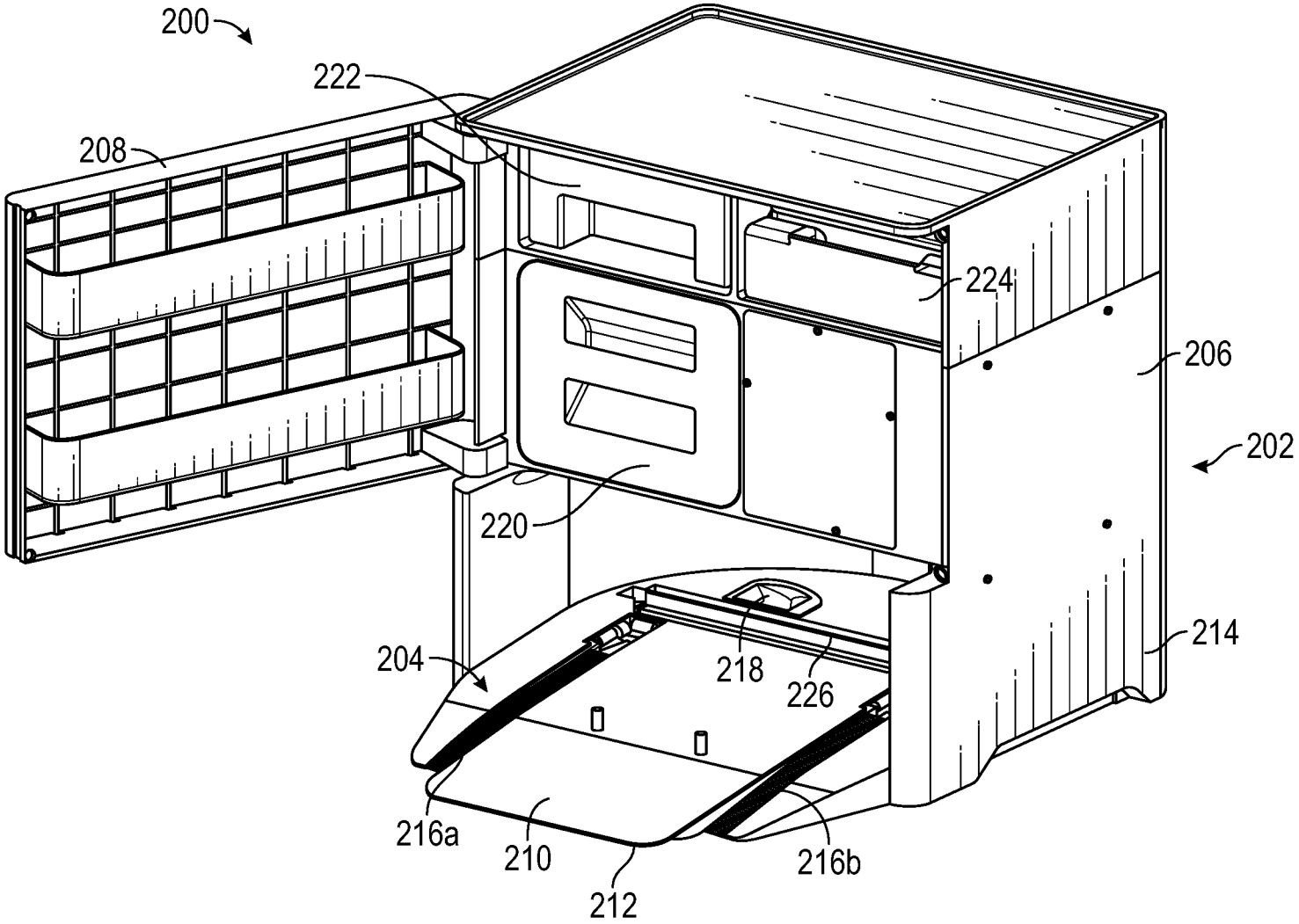
FIG. 3 illustrates an isometric view of a docking station.

FIG. 3 illustrates an isometric view of the docking station 200. The docking station 200 can be consistent with the docking station 200 of FIG. 2; FIG. 3 shows additional details of the docking station 200. For example, FIG. 3 shows that the cover 208 can be removed or opened to provide access to a debris bin 220, which can receive debris from the robot 100, such as via the vacuum port 218. Optionally, the debris bin 220 can support a debris bag therein, which can be user-replaceable.

Opening of the cover 208 can also provide access to a clean water tank 222 and a dirty water tank 224 (or a gray water tank 224). Each of the clean water tank 222 and the dirty water tank 224 can be user-removable from the canister 202 when the cover 208 is open. For example, the clean water tank 222 can be removed for refilling of the clean water tank 222 with fresh water or cleaning fluid and the dirty water tank 224 can be removed from the canister 202 for emptying dirty water from the dirty water tank 224. The cover 208 can provide improved access to the pad cleaning system 226 such as for user maintenance, and can provide access to one or more storage areas of the canister 202.

FIG. 3 also shows that the docking station 200 can include a pad cleaning system 226 connected to the base 204, such as to the platform 210. The pad cleaning system 226 can optionally include the clean water tank 222 and the dirty water tank 224 or can be connected thereto. As discussed in further detail below, the pad cleaning system 226 can include a reservoir configured to retain liquid therein and can include an agitator located at least partially within the reservoir, where the agitator is engageable with a cleaning pad of the mobile cleaning robot 100, such as to clean the pad of the robot 100. Additional details of the docking station 200 are discussed below.

Figure 4:
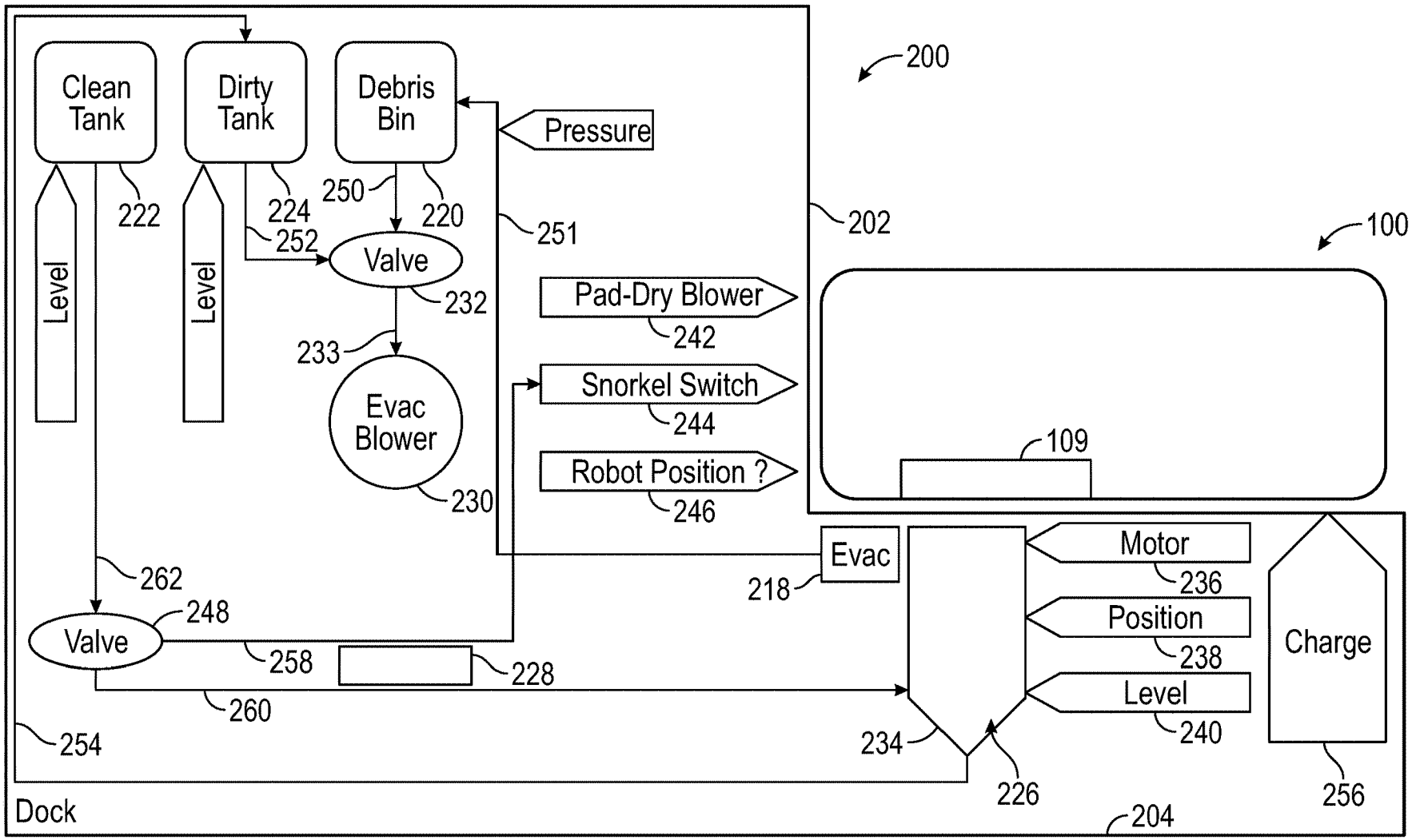
FIG. 4 illustrates a schematic view of a docking station.

FIG. 4 illustrates a schematic view of the docking station 200. The docking station 200 can be consistent with the docking station 200 of FIGS. 2-3; FIG. 4 shows additional details of the docking station 200. For example, FIG. 4 shows that the docking station 200 can include additional components such as a controller 228 that can be connected to the canister 202 or the base 204. Optionally, the controller 228 can be located external to the docking station 200 or can be replaced with a controller of the robot 100 or a user device.

The controller 228 can be a programable controller, such as a single or multi-board computer, a direct digital controller (DDC), a programable logic controller (PLC), or the like. In other examples the controller 228 can be any computing device, such as a handheld computer, for example, a smart phone, a tablet, a laptop, a desktop computer, or any other computing device including a processor, memory, and communication capabilities. The controller 228 can be connected to (e.g., in communication with) one or more of the operating components or sensors of the docking station 200, as discussed below.

FIG. 4 also shows that the docking station 200 can include a blower 230 that can be connected to the debris bin 220 (such as via one or more ducts) and can be connected to the dirty water tank 224 (such as via one or more separate ducts). The blower 230 can be a fan, pump, or the like that can be operable to generate an evacuation stream to draw debris out of the mobile cleaning robot 100, through the evacuation port 218, and into the debris bin 220, before exhausting the evacuation stream into the environment. The evacuation stream can also pass through other devices such as a filter or a valve 232. The valve 232 can be connected to the blower 230 (such as via a blower duct 233), the debris bin 220, and the dirty water tank 224.

FIG. 4 also shows that the pad cleaning system 226 can be at least partially connected to the base 204 and can include a reservoir 234. The reservoir 234 can be connected to the clean water tank 222 through one or more water lines (e.g., tubes or pipes) and can be configured to receive clean water therefrom such as to retain the clean water therein for use in cleaning the pad 109 of the robot 100.

The pad cleaning system 226 can also include a roller (shown in later figures) and a motor 236 that can be connected to the roller and can be operable to rotate the roller to clean the pad 109 of the robot 100. The pad cleaning system 226 can also include a roller position sensor 238 and a water level sensor 240. The roller position sensor 238 can be connected to the reservoir 234, a roller actuator (e.g., encoder), or the roller and can be in communication with the controller 228 to transmit a signal thereto indicative of a position of the roller (e.g., with respect to the base 204 or the reservoir 234 or the pad 109). The water level sensor 240 can be in communication with the controller 228 and can be configured to transmit a signal thereto indicative of a level of water or fluid within the reservoir 234.

The docking station 200 can also include a pad dryer blower 242, a fill spout switch 244, and a position sensor 246. The pad dryer blower 242 can be connected to the canister 202 or the base 204 and can be in communication with the controller 228. The pad dryer blower 242 can be operable to discharge a drying stream (e.g., of air) to or toward the pad 109 (when the pad is in a drying position). Optionally, the pad dryer blower 242 can include a heater (internally or externally) to heat the air prior to discharge.

The fill spout switch 244 can be connected to a fill snorkel (discuss below) and can be in communication with the controller 228. The fill spout switch 244 can be configured to produce a signal and transmit the signal to the controller 228, where the signal can be indicative of a position of the snorkel with respect to the robot 100 or the docking station 200 (e.g., the canister 202 or the base 204). The position sensor 246 can be connected to the canister 202 or the base 204 and can be in communication with the controller 228. The position sensor 246 can be configured to produce a signal and transmit the signal to the controller 228, where the signal can be indicative of a position of the robot 100 with respect to the docking station 200.

The docking station 200 can also include a fluid valve 248 that can be connected to the clean water tank 222, the fill spout, and the reservoir 234. The fill spout (shown in FIG. 7 below) can be connected to the canister 202 or the base 204 and can be engageable with the robot 100 to deliver clean fluid to the robot. The fluid valve 248 can be in communication with the controller 228 and can be operated thereby to selectively deliver fluid from the clean water tank 222, which can optionally be heated prior to delivery, to at least one of the reservoir 234 or the fill spout. The docking station 200 can include a pump or can optionally deliver fluid to the fill spout or the reservoir 234 using gravity.

The docking station 200 can also include a debris exhaust duct 250 connected to the valve 232 and connected to the debris bin 220. The docking station 200 can include a debris duct 251 connected to the debris port 218 and connected to the debris bin 220. The docking station 200 can include a fluid exhaust duct 252 connected to the valve 232 and connected to the disposal tank 224. The docking station 200 can also include a fluid pipe 254 connected to the reservoir 234 and connected to the disposal tank 224.

The valve 232 can be operable (e.g., via the controller 228) to direct the evacuation stream through the pad cleaning system 226 (e.g., from the reservoir 234), through the fluid pipe 254, carrying fluid into the dirty water tank 224 and allowing the evacuation stream (less the liquid) to travel to the blower 230. The valve 232 can also be operable to direct the evacuation stream through the vacuum port 218 and the debris duct 251 and to the debris bin 220, carrying debris into the debris bin 220 (such as in a debris bag therein), and allowing the evacuation stream (less the debris) to travel to the blower 230. The controller 228 can be in communication with the valve 232 to control operation of the valve 232 to direct the evacuation stream through one path or the other as required depending on an operation mode or function of the docking station 200.

FIG. 4 also shows charging contacts 256, which can be connected to a power supply and engageable with contacts of the robot 100. The contacts 256 are discussed in further detail below. FIG. 4 also shows that the fluid valve 248 can be connected to the fill spout via a fill spout line 258, which can be located at least partially within the base 204 or the canister 202. The fluid valve 248 can also be connected to the reservoir 234 via a reservoir fill line 260, which can be located at least partially within the base 204 or the canister 202. The fluid valve 248 can also be connected to the clean water tank 222 via a supply line 262. Optionally, the supply line 262 can be two lines connected to the fluid valve 248. As discussed in further detail below, the fluid valve 248 can be operable to deliver fluid from the supply line 262 (from the clean water tank 222) to one of the fill spout line 258 or the reservoir fill line 260. Optionally, the line 260 can be two lines, one delivered to each end of the pad cleaning system 226.

Figure 5:
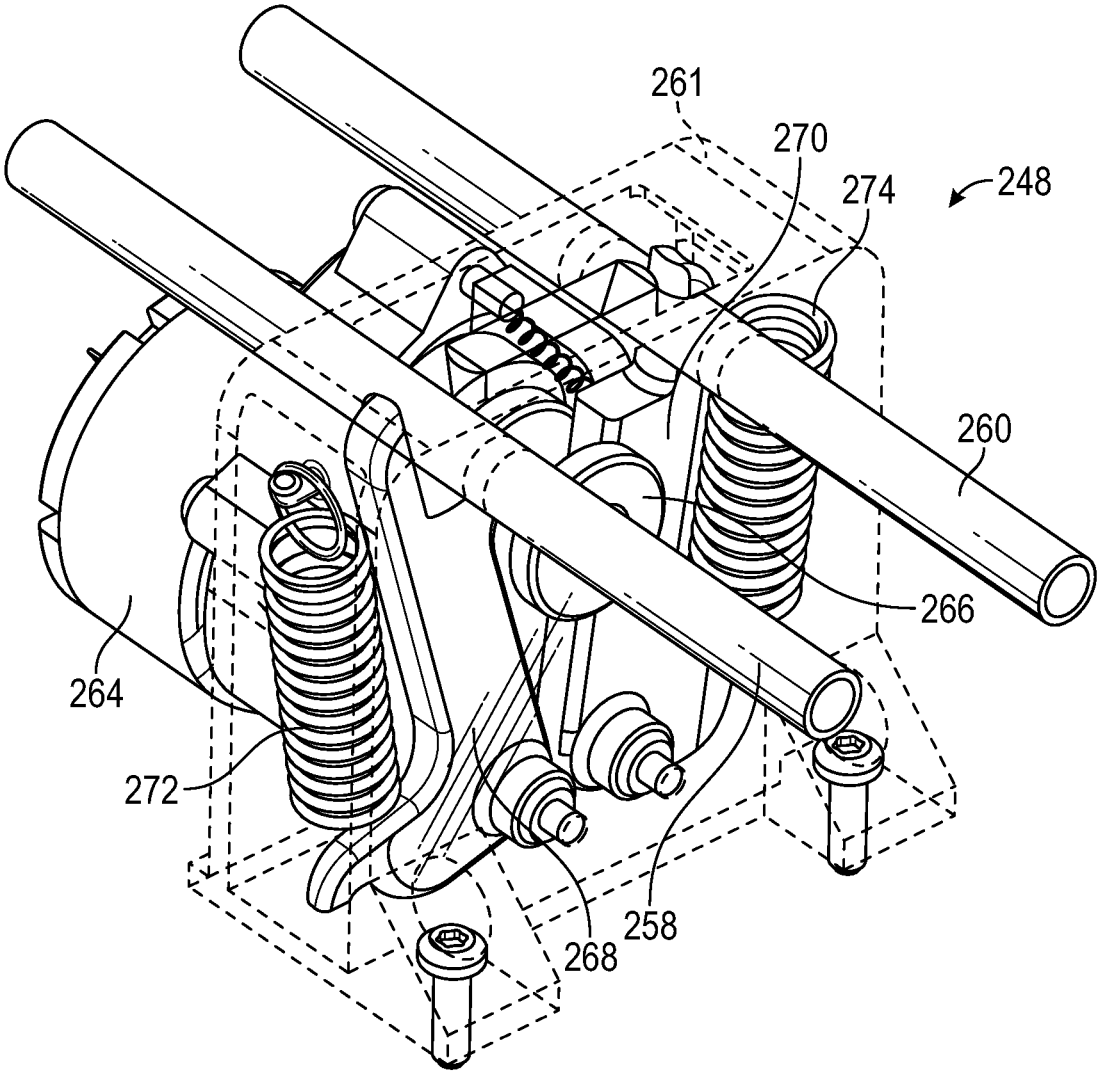
FIG. 5 illustrates an isometric view of a portion of a docking station.

FIG. 5 illustrates an isometric view of the fluid valve 248. The fluid valve 248 can be consistent with the fluid valve 248 of FIG. 4. FIG. 5 shows additional details of the fluid valve 248. For example, FIG. 5 shows that the fluid valve 248 can include a body 261 configured to connect the fluid valve 248 to the fill spout line 258 and the reservoir fill line 260. Each of the fill spout line 258 and the reservoir fill line 260 can extend through the body 261 and can optionally connect to the clean water tank 222. Each of the fill spout line 258 and the reservoir fill line 260 (or at least the portions of the fill spout line 258 and the reservoir fill line 260 interacting with the fluid valve 248) can be relatively flexible.

The fluid valve 248 can also include a motor 264 connected to the body 261. The motor 264 can be in communication with the controller 228 such that the controller 228 can operate the motor 264. The motor 264 can be connected to a cam 266 that can be engageable with armatures 268 and 270. The armatures 268 and 270 can be connected to the body and can be pivotable with respect thereto. The armature 268 can be engageable with the fill spout line 258 to close the fill spout line 258 such as to limit fluid from passing through the fill spout line 258. Similarly, armature 270 can be engageable with the reservoir fill line 260 to close the reservoir fill line 260 such as to limit fluid from passing through the reservoir fill line 260. The fluid valve 248 can also include biasing elements 272 and 274 connected to the body 261 and to the armatures 268 and 270, respectively. The biasing elements 272 and 274 can be configured to bias the armatures 268 and 270, respectively, to open or closed positions.

In operation, the controller 228 can operate the motor 264 to rotate the cam 266 to move either the armatures 268 and 270 between open and closed positions. In open positions, the armatures 268 and 270 can allow fluid to flow respectively through the fill spout line 258 and the reservoir fill line 260 and in closed positions, the armatures 268 and 270 can limit flow of fluid respectively through the fill spout line 258 and the reservoir fill line 260. Further details of operation are discussed below with respect to FIGS. 6A-6C, which show a valve 648 that operates similarly to the fluid valve 248.

Figure 6C:
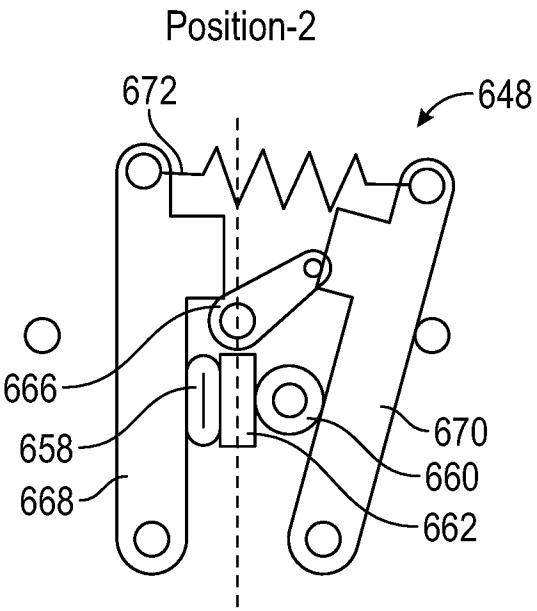
FIG. 6C illustrates a schematic view of a portion of a docking station in a third condition.
Figure 6B:
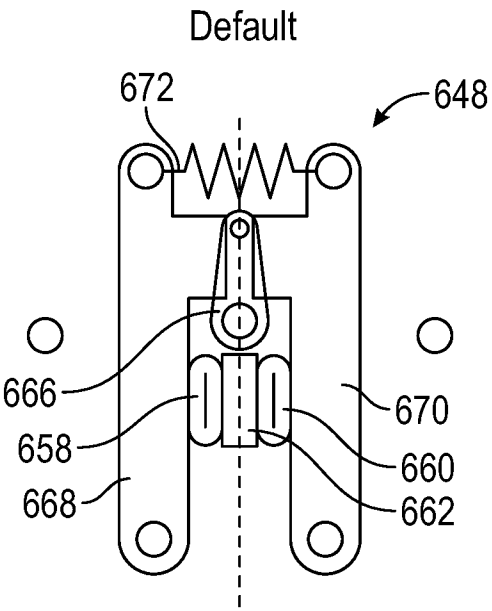
FIG. 6B illustrates a schematic view of a portion of a docking station in a second condition.
Figure 6A:
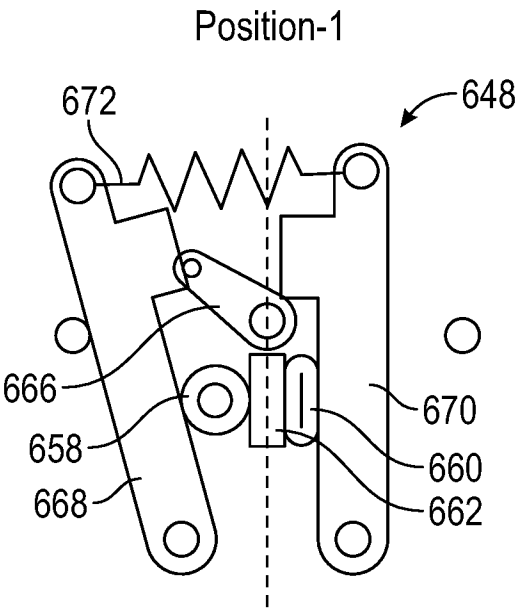
FIG. 6A illustrates a schematic view of a portion of a docking station in a first condition.

FIG. 6A illustrates a schematic view of the valve 648 in a first position or condition. FIG. 6B illustrates a schematic view of the valve 648 in a default position or condition. FIG. 6C illustrates a schematic view of the valve 648 in a second position or condition. FIGS. 6A-6C are discussed together below. The valve 648 can be similar to the fluid valve 248. Any of the valves discussed above or below can include the features of the valve 648.

As shown in FIG. 6A, when a motor (e.g., the motor 264) is operated to rotate the cam 666 to a first position, the cam 666 can contact the armature 668 to move the armature 668 to an open position, such that the fill spout line 658 is uninhibited or is not compressed by the armature 668 and the body 662, whereas the cam 666 does not engage the armature 670 and the biasing element 672 biases the armature 670 to engage the reservoir fill line 660 to close the reservoir fill line 660.

As shown in FIG. 6B, when the motor (e.g., the motor 264) is not operated to rotate the cam 666, the biasing element 672 can move the cam 666 to the default position such that the cam 666 cannot be engaged with either of the armatures 668 or 670 and such that the armatures are biased by the biasing element 672 to closed positions, causing the armature 668 and the armature 670 to engage the fill spout line 658 and the reservoir fill line 660, respectively, closing the fill spout line 658 and the reservoir fill line 660. In this way, the motor does not need to be operated to close the fill spout line 658 and the reservoir fill line 660, helping to ensure that fluid automatically shuts off in the case that power is lost (to help prevent uncontrolled water dispensing).

As shown in FIG. 6C, when the motor (e.g., the motor 264) is operated to rotate the cam 666 to a second position, the cam 666 can contact the armature 670 to move the armature 670 to an open position, such that the reservoir fill line 660 is uninhibited or is not compressed by the armature 670 and the body 662, whereas the cam 666 does not engage the armature 668 and the biasing element 672 biases the armature 668 to engage the fill spout line 658 to close the fill spout line 658. In this way, the controller 228 can operate the valve 648 (or the fluid valve 248) to allow flow from the clean water tank 222 through either fill spout line 658 or the reservoir fill line 660.

Figure 7:
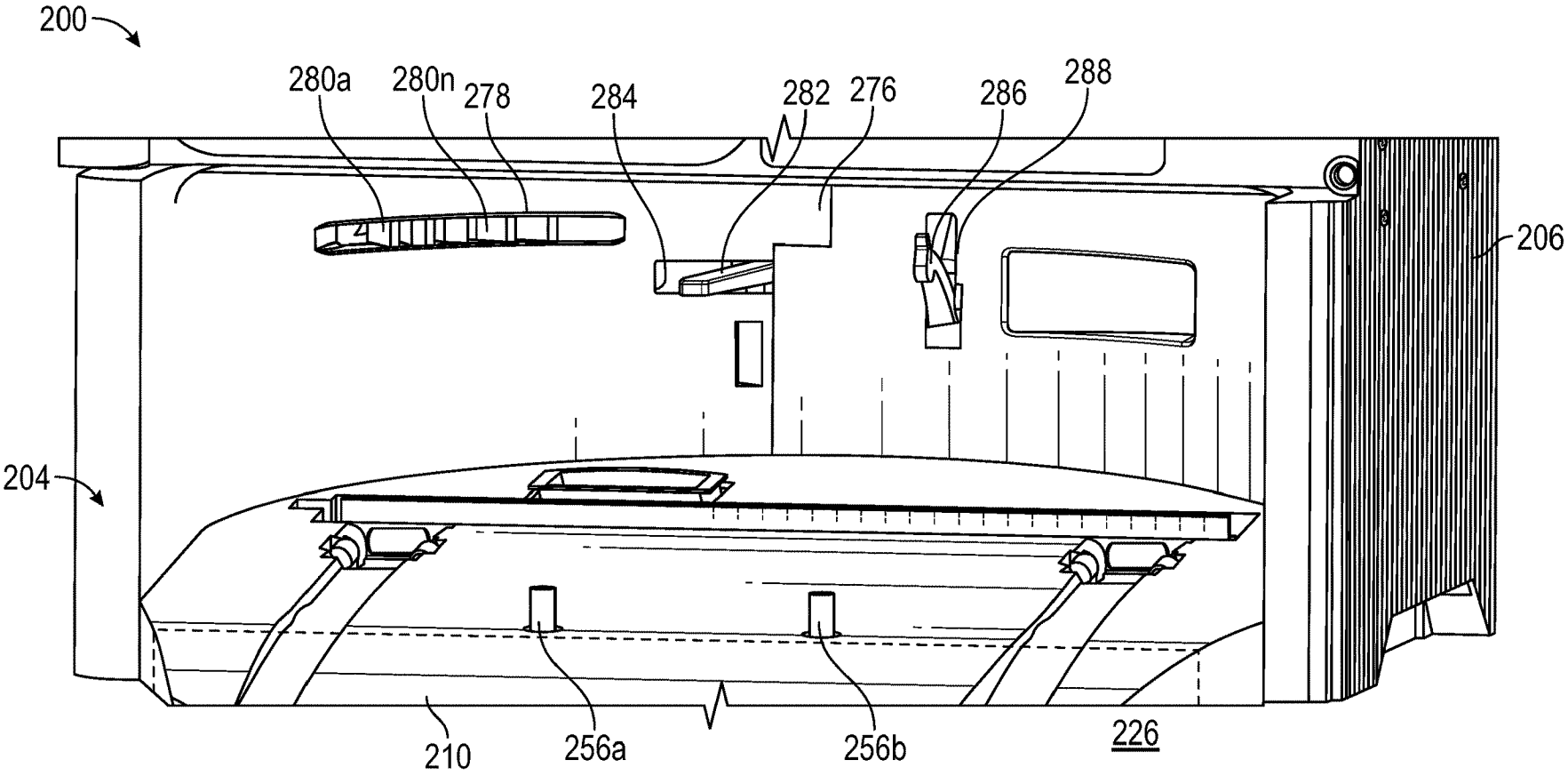
FIG. 7 illustrates an enlarged isometric view of a portion of a docking station.

FIG. 7 illustrates an enlarged isometric view of a portion of the docking station 200. The docking station 200 can be consistent with FIGS. 2-5 discussed above. FIG. 7 shows additional details of the docking station 200. For example, FIG. 7 more clearly shows a rear wall 276 of the base 204 (or of the canister 202). Optionally, the rear wall 276 can be curved and can include one or more openings therein or therethrough (at least partially). FIG. 7 also shows how the contacts 256 can extend from the platform 210.

The rear wall 276 can define a dryer opening 278 that can extend through the rear wall 276. Optionally, the docking station 200 can include one or more baffles 280*a*-280*n* (collectively referred to as baffles 280) that can be located at least partially in the dryer opening 278 and can be configured to direct airflow from a dryer blower to the pad 109 when the pad 109 is in a drying position.

The docking station 200 can also include a fill spout 282 that can be connected to the base 204 or the docking station 200 (and can be fluidly connected to the fill spout line 258) and can extend at least partially through a fill spout opening 284. As discussed in further detail below, the fill spout 282 can be at least partially insertable into the robot 100 to deliver fluid (e.g., cleaning liquid) to the robot 100.

The docking station 200 can also include a lift arm 286 that can be connected to the canister 202 or the base 204 and can extend at least partially through an arm opening 288 of the rear wall 276. As discussed in further detail below, the lift arm 286 can be engageable with a pad tray of the pad assembly 108 of the mobile robot 100 to lift the pad tray and the cleaning pad 109 with respect to a body of the robot 100.

Figure 8A:
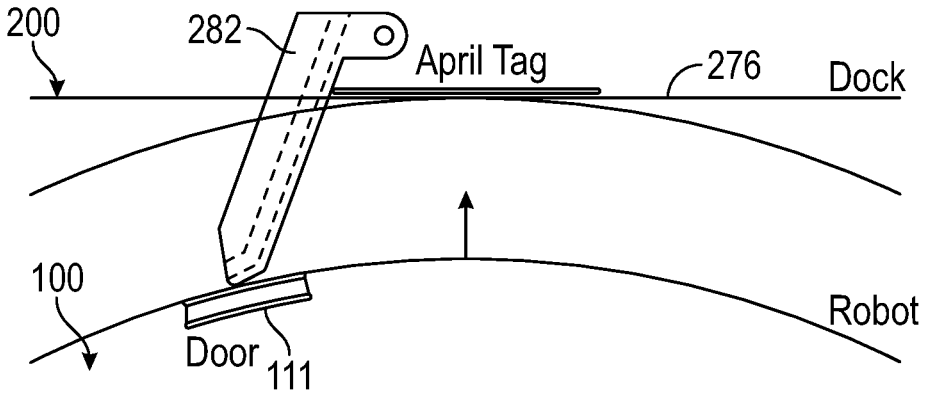
FIG. 8A illustrates a schematic view of a portion of a robot and docking station in a first condition.
Figure 8B:
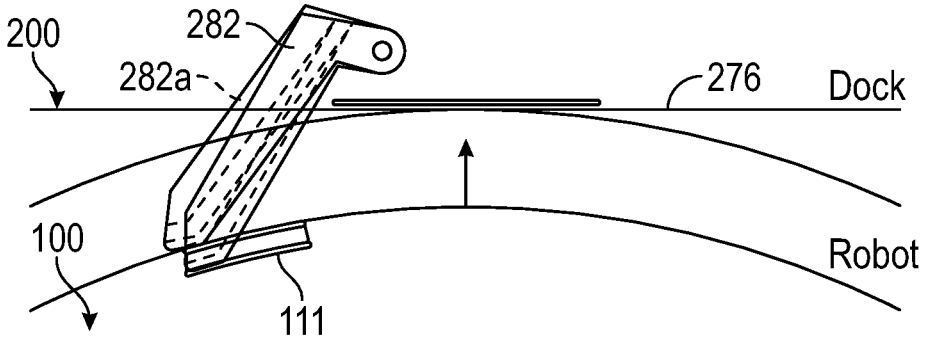
FIG. 8B illustrates a schematic view of a portion of a robot and docking station in a second condition.
Figure 8C:
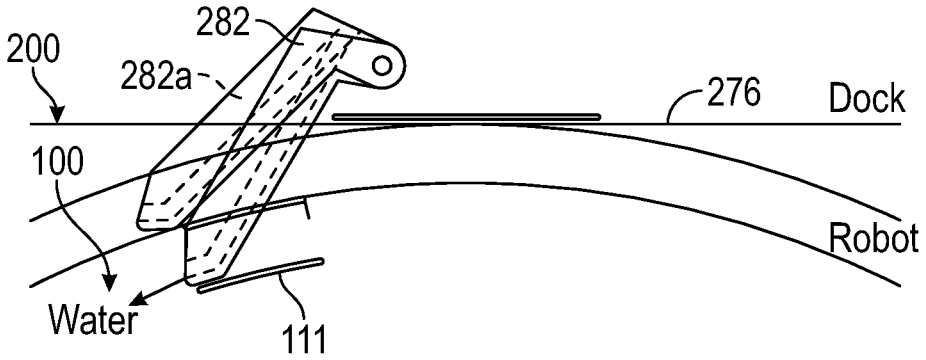
FIG. 8C illustrates a schematic view of a portion of a robot and docking station in a third condition.

FIG. 8A illustrates a schematic view of a portion of the robot 100 and the docking station 200 in a first condition. FIG. 8B illustrates a schematic view of a portion of the robot 100 and the docking station 200 in a second condition. FIG. 8C illustrates a schematic view of a portion of a robot and docking station in a third condition. FIGS. 8A-8C are discussed together below.

FIGS. 8A-8C show the fill spout 282 extending from the rear wall 276. FIGS. 8A-8C also show that the fill spout 282 can be pivotably connected to the canister 202 or the base 204. As shown in FIG. 8A, as the robot 100 approaches the fill spout 282, the fill spout 282 can engage a door 111 of the robot 100. In normal operation, the fill spout 282 can engage the door 111, opening the door 111 for insertion into the robot 100, allowing fluid to be dispensed from the clean water tank 222 into the robot 100.

However, in some instances, as shown in FIGS. 8B and 8C, the fill spout 282 can miss the door 111 and can rotate past the door, as indicated by the fill spout 282*a* of FIGS. 8B and 8C. In such instances, it is desirable to know that the fill spout 282 has missed its target to help avoid distributing fluid from the fill spout 282 when the fill spout 282 is not within the robot 100. The fill spout switch 244 can detect a miss of the fill spout 282*a* by detecting over-rotation of the fill spout 282 with respect to the base 204, canister 202, or dryer opening 278, and the fill spout switch 244 can transmit a signal to the controller 228. The controller 228 can use the signal to limit distribution of fluid from the clean water tank 222 to the robot 100. Similarly, the fill spout switch 244 can be a sensor configured to produce a signal indicative of a rotational position of the fill spout 282, which the controller can use to determine whether the fill spout 282 was properly inserted into the robot 100. Optionally, the docking station 200 can include a biasing element to bias the fill spout 282 toward the neutral or default position (which is the position that will engage the door 111 when the robot 100 is properly aligned on the platform 210).

Such a fill spout can use a relatively low force allowed to the robot 100 to open the door of the robot 100. If the fill spout 282 misses the door, it folds out of the way (as shown in FIGS. 8B and 8C). If the fill spout 282 does hit the door of the robot 100, the fill spout 282 can engage a wall of the door 111 or the opening of the door 111 before force sufficient to open the door 111 is transmitted from the fill spout 282 to the door 111. Use of these components can help to minimize a force applied by the robot 100 to the force required to open the door 111, helping to reduce loading on the robot 100.

Figure 9A:
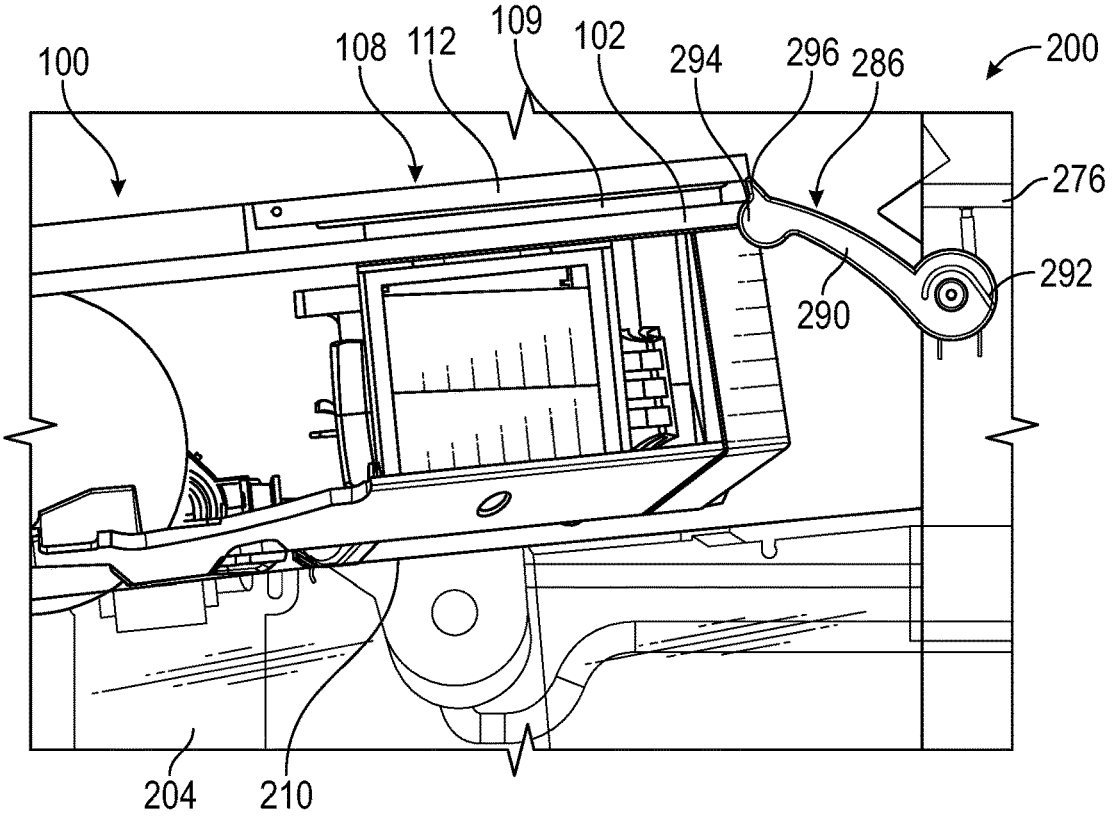
FIG. 9A illustrates a schematic view of a portion of a robot and docking station in a first condition.
Figure 9B:
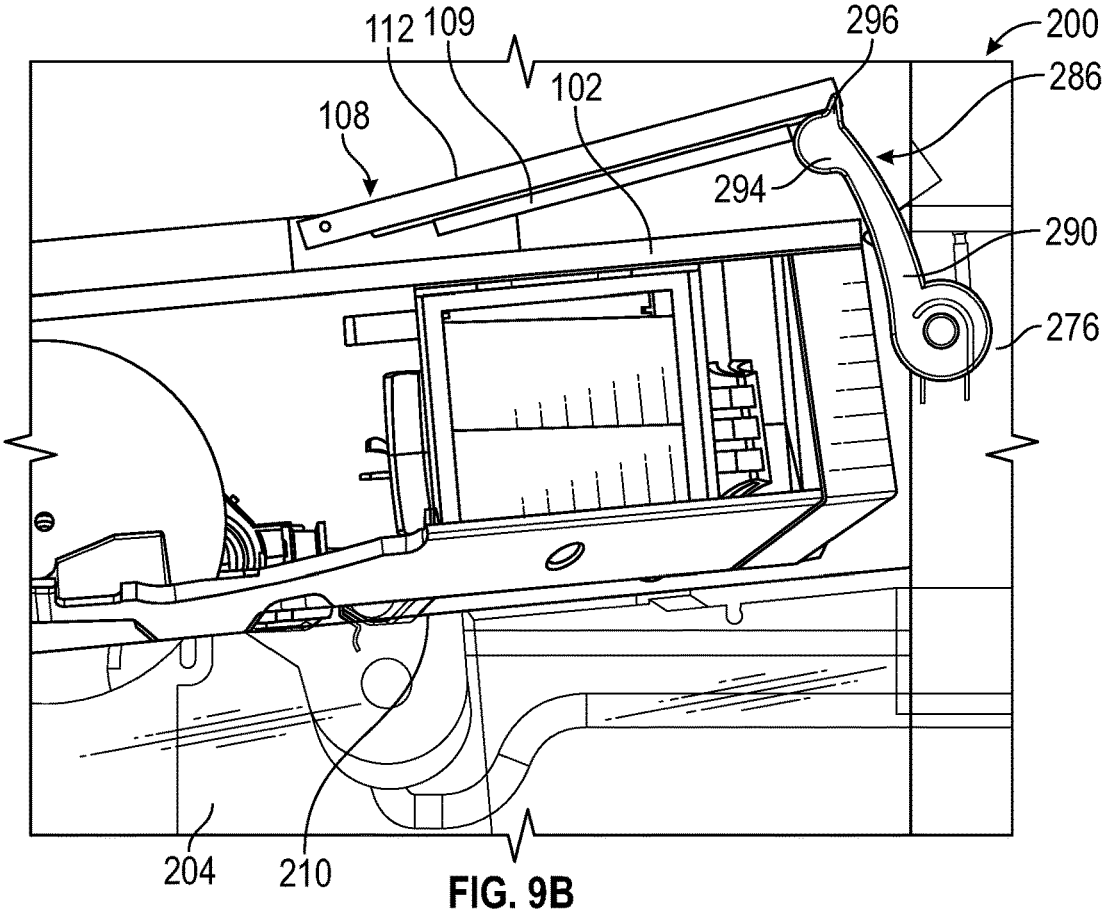
FIG. 9B illustrates a schematic view of a portion of a robot and docking station in a second condition.

FIG. 9A illustrates a schematic view of a portion of the robot 100 and the docking station 200 with the pad assembly 108 in a first position and FIG. 9B illustrates a schematic view of a portion of a robot 100 and the docking station 200 with the pad assembly 108 in a second position. FIGS. 9A and 9B are discussed together below. The robot 100 and the docking station 200 can be consistent with the robot 100 and the docking station 200 discussed above.

FIGS. 9A and 9B show how the docking station 200 can interact with the pad assembly 108 for drying of the pad 109. More specifically, FIGS. 9A and 9B show that the lift arm 286 can include an arm 290 rotatably connected to the canister 202 or the base 204. As shown in FIG. 9A, the lift arm 286 can include a biasing element 292 engageable with the canister 202 or the base 204 to bias the lift arm 286 to rotate downward. Optionally, the lift arm 286 can be biased via gravitational forces. The lift arm 286 can also include a head 294 connected to a distal end of the arm 290, where the lift arm 286 can include a projection 296 extending outwardly from the head 294.

In operation, as shown in FIG. 9A, as the robot 100 rides up the platform 210 with the pad assembly 108 stored, as shown in FIG. 1A, and approaches the rear wall 276 for pad drying, such as following a pad washing routine, the projection 296 or the head 294 can engage a forward portion of the pad 109 or the pad tray 112 (which can support the pad on an underside thereof). As shown in FIG. 9B, as the robot 100 continues to move toward the rear wall 276, the head 294 can slide up a back wall of the robot and into a gap between the pad 109 and the pad tray 112 and the projection 296 can engage a rear edge of the pad tray 112, such that the head 294 and the projection 296 can retain the pad tray 112 on the lift arm 286, helping to limit the pad assembly 108 from overrunning the lift arm 286, thus forcing the lift arm 286 to continue to rotate and lift the pad assembly 108 as the robot backs up the platform 210. The head 294 can be profiled such as to limit catching on other portions or parts of the robot 100.

During this movement of the robot 100, the lift arm 286 can rotate upward as a force applied by the robot 100 overcomes a biasing force of the biasing element 292 (and gravity), causing the pad 109 and the pad tray 112 to rotate up as well until the robot 100 reaches its drying position on the platform 210 (or until the lift arm 286 reaches a rotational limit, such as through engagement between the lift arm 286 and the canister 202 or the base 204). This rotation of the pad 109 and the pad tray 112 can result in lifting of the pad 109 and the pad tray 112 off (or away from) the body 102 of the robot 100, allowing air flow produced by the dryer blower 242 of the docking station 200 to pass between the pad 109 and the pad tray 112, helping to reduce drying time of the pad 109 when wet.

Figure 10:
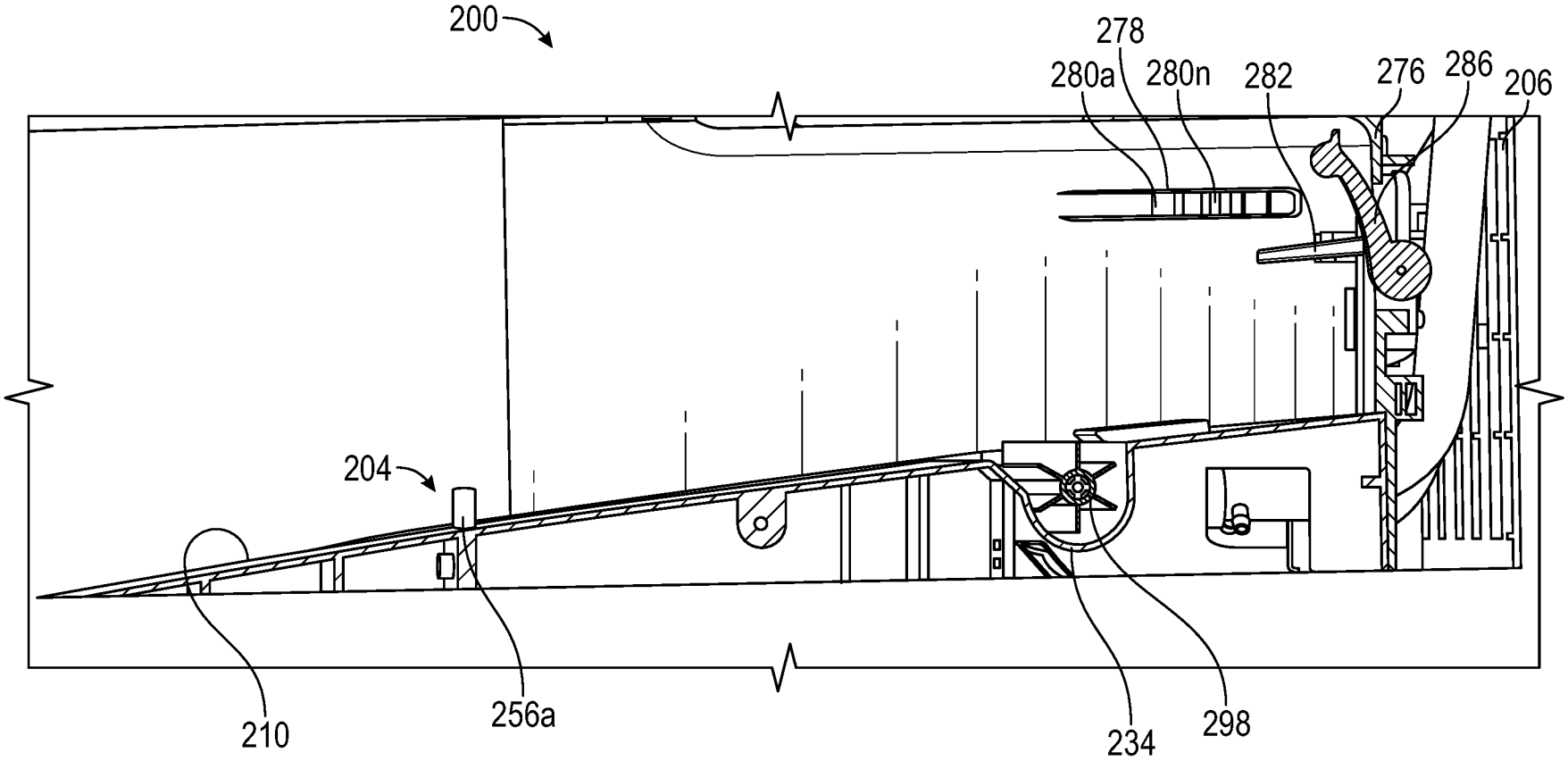
FIG. 10 illustrates a cross-sectional view of a portion of docking station.

FIG. 10 illustrates a cross-sectional view of a portion of the docking station 200. The docking station 200 of FIG. 10 can be consistent with the docking station 200 discussed above. FIG. 10 shows additional details of the docking station 200. For example, FIG. 10 shows that the dryer opening 278 can be located near a side of the rear wall 276 and the opening (and the baffles 280) can be configured to direct dryer blower air across the docking station 200 to allow the air to pass between the pad 109 and the body 102 of the robot 100 when the pad 109 is in the drying position of FIG. 9B.

FIG. 10 also shows the reservoir 234, which can extend downward from the platform 210 to form the reservoir. The reservoir 234 can also support a roller 298 (or cleaning head or agitator) therein. The roller 298 can be driven by the motor 236 to rotate within the reservoir 234 and can be engageable with the pad 109 when the pad 109 is in a cleaning or deployed position (shown in FIG. 1C). The roller 298 can be wetted by cleaning fluid within the reservoir 234 such as to perform a wet cleaning or scrubbing of the pad 109, or can be wetted to pre-wet the pad 109, such as prior to beginning a cleaning mission, to help reduce fluid tank size of the robot 100

FIG. 10 also shows how the contact 256*a* can extend from the platform 210 of the base 204, as discussed in further detail below.

Figure 11:
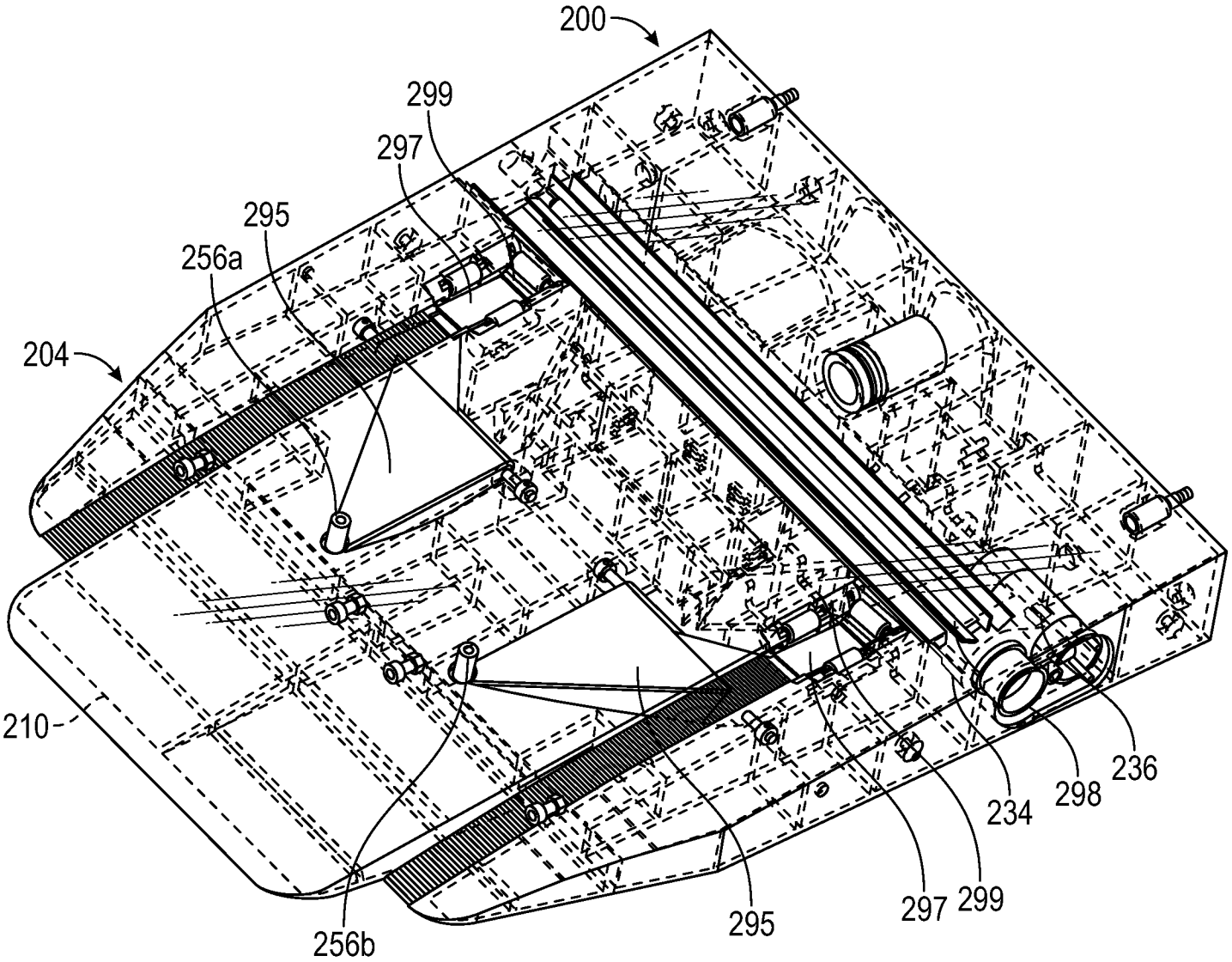
FIG. 11 illustrates an isometric view of a portion of a docking station.

FIG. 11 illustrates an isometric view of the platform 210 of the docking station 200. The docking station 200 of FIG. 11 can be consistent with the docking station 200 discussed above. FIG. 11 shows additional details of the docking station 200. For example, FIG. 11 shows the motor 236 connected to the roller 298 within the reservoir 234.

FIG. 11 also shows how the contacts 256 can operate. The contacts 256 can each be integrated into (or connected to) a rocker 295 (or lever). The rocker 295 can be located at least partially within the platform 210 and can include a wheel pad 297. The wheel pads 297 can respectively be located at least partially within wheel cradles 299 of the platform 210, such that the wheel pads 297 can only be contacted by the drive wheels of the robot 100 when the drive wheels are located within the wheel cradles 299.

When the drive wheels rest on the wheel pads 297, the rockers 295 can pivot or rotate to extend the charging contacts 256*a* and 256*b* from the platform 210 to engage charging contacts of the robot 100. When the drive wheels do not rest on the wheel pads 297, the rockers 295 can be rotated down (or biased downward by default) such that the charging contacts 256*a* and 256*b* can retract at least partially into the platform 210. In this way, contact between the robot 100 (especially the pad 109) and the charging contacts 256*a* and 256*b* can be limited until the drive wheels are located within the wheel cradles 299 and the charging contacts of the robot 100 are aligned with the charging contacts 256*a* and 256*b*, which can help protect the contacts 256*a* and 256*b* from becoming contaminated.

Also, because the rockers 295 can be independently actuated by each of the independent drive wheels of the robot 100, the controller 228 or the controller of the robot 100 can determine that both drive wheels are in the wheel cradles 299, when the controller 228 determines that the circuit is complete indicating that the robot 100 is fully or properly docked on the robot 100, helping to confirm proper docking of the robot 100 on the docking station 200.

Figure 12:
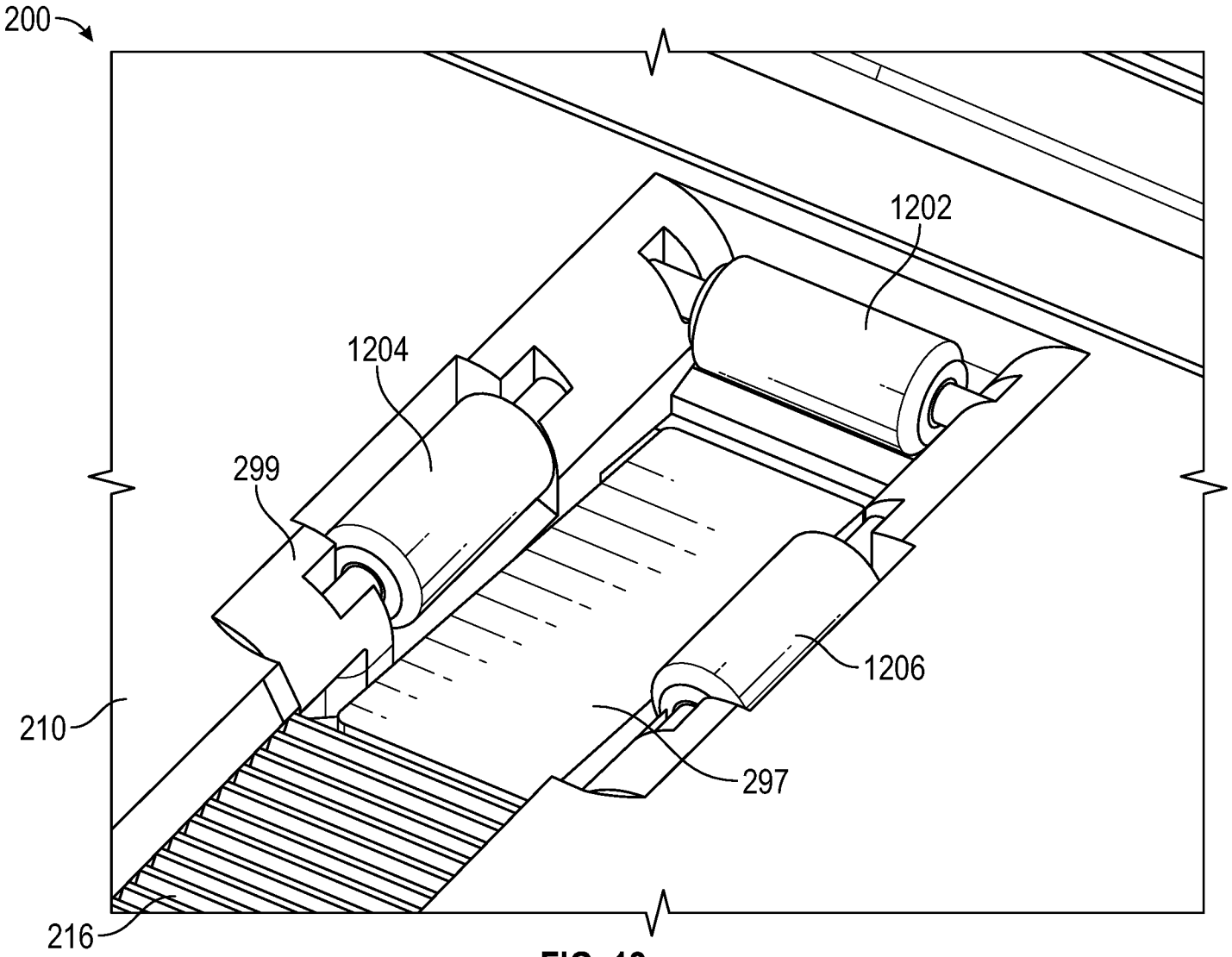
FIG. 12 illustrates an enlarged isometric view of a portion of a docking station.

FIG. 12 illustrates an enlarged isometric view of the docking station 200. The docking station 200 of FIG. 12 can be consistent with the docking station 200 discussed above. FIG. 12 shows additional details of the docking station 200. For example, FIG. 12 shows additional details of the platform 210.

The platform 210 can include the wheel cradles 299, as discussed above in FIG. 11. As shown in FIG. 12, the wheel cradle 299 can be aligned with the track 216 and can extend downward into the platform 210. The wheel pad 297 can be located at least partially in the wheel cradle 299.

FIG. 12 also shows that the platform 210 can include a rear roller 1202 located at a rear portion of the wheel well 299. The rear roller 1202 can be rotatable with respect to the platform 210 and can be engageable with the drive wheel to limit movement of the mobile robot 100 toward the rear wall 276. The rear roller 1202 can also urge the drive wheel into the wheel well 299.

The platform 210 can also include side rollers 1204 and 1206, which can be located at lateral portions of the wheel well 299. The side rollers 1204 and 1206 can be (e.g., each or independently) engageable with the drive wheel to urge the drive wheel into the wheel well. In this way, the rollers can help to ensure that the drive wheel enters the wheel cradles 299 and engages the wheel pads 297, as the rollers can compensate for misalignment as the robot 100 moves onto the platform 210. The surface of the platform 210 can also be sculpted or rounded, to further help the wheels move into the cradles 299. The rollers can also help reduce upward forces on the wheels that could reduce downward force by the wheels against the wheel pads 297, helping to ensure that the wheels apply a consistent force to the wheel pads 297. Though only one wheel well is discussed with respect to FIG. 12, the features discussed can be included on both wheel wells, as shown in other FIGS. (such as FIG. 11).

Figure 13:
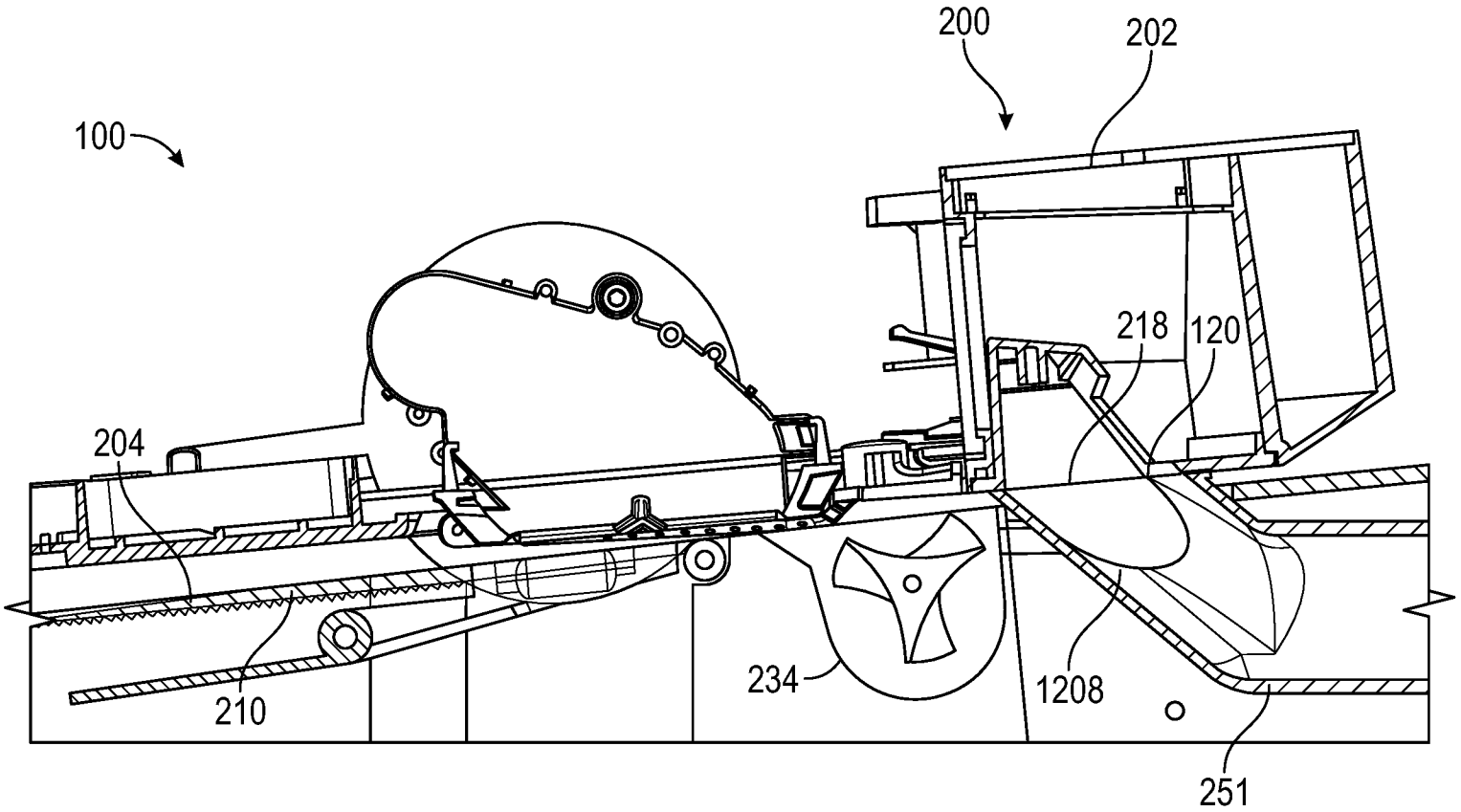
FIG. 13 illustrates a cross-sectional view of a portion of docking station.

FIG. 13 illustrates a cross-sectional view of a portion of a docking station 200. The docking station 200 of FIG. 13 can be consistent with the docking station 200 discussed above. FIG. 13 shows additional details of the docking station 200. For example, FIG. 13 shows additional details of the debris duct 251 and its interaction with the robot 100.

More specifically, FIG. 13 shows that the debris duct 251 can extend down and can terminate at an end portion 1208 to at least partially define the vacuum port 218. FIG. 13 also shows that the end portion 1208 can be movable with respect to the base 204, the platform 210, the canister 202, and the robot 100. For example, operation of the blower 230 can create sufficient suction to move the end portion 1208 (and the vacuum port 218) to engage a debris port 120 of the mobile cleaning robot 100 when the mobile robot 100 is docked on the base. When the blower 230 draws the end portion 1208 to engage the debris port 120, a seal can be formed between the debris port 120 and the vacuum port 218. Optionally, the end portion 1208 can extend at least partially over the reservoir 234 when drawn out by the blower 230 and can retract at least partially into the platform 210 when the blower 230 is disabled.

Figure 14:
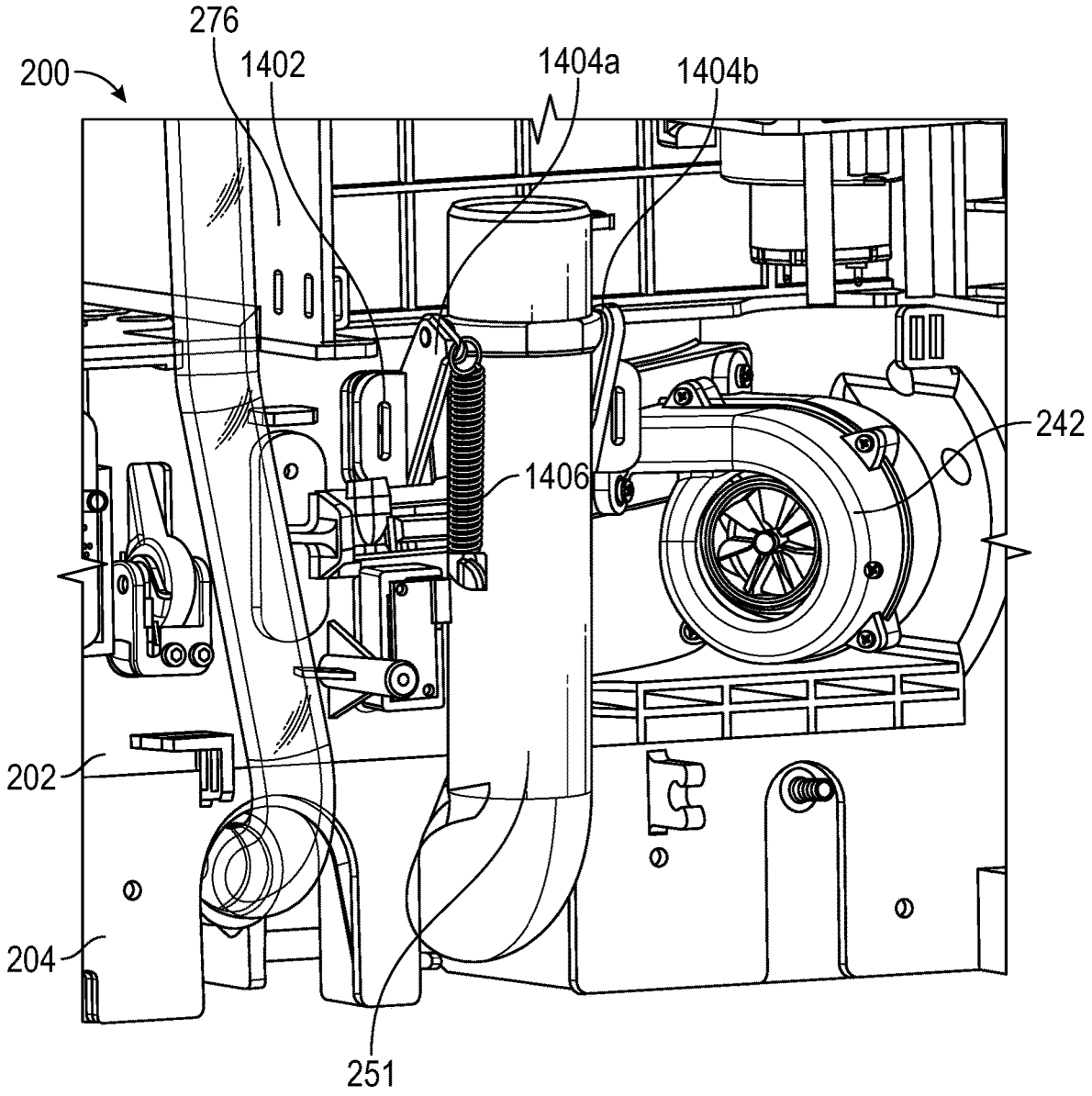
FIG. 14 illustrates an enlarged isometric view of a portion of a docking station.

FIG. 14 illustrates an enlarged isometric view of a portion of a docking station. The docking station 200 of FIG. 14 can be consistent with the docking station 200 discussed above. FIG. 14 shows additional details of the docking station 200. For example, FIG. 14 shows how the debris duct 251 can be connected to the canister 202 to allow relative motion of the debris duct 251 with respect to the canister 202 and the base 204.

The docking station 200 can include a mount 1402 secured to the canister 202, such as to the rear wall 276. The mount 1402 can optionally be connected to the base 204. The docking station 200 can also include links 1404*a* and 1404*b* connected to the mount 1402 and connected to the debris duct 251. The links 1404*a* and 1404*b* can be pivotably connected to the debris duct 251, such as via pins, allowing the debris duct 251 to rotate to produce movement of the end portion 1208.

The docking station 200 can also include a biasing element 1406, which can be connected to the debris duct 251 and to one or more of the links 1404 (e.g., to the link 1404*a*). the biasing element 1406 can be a spring, such as a coiled extension spring. The biasing element 1406 can be configured to bias the debris duct 251 (and the end portion 1208) away from the extended position shown in FIG. 12, allowing the vacuum port 218 to retract when the blower 230 is disabled.

FIG. 14 also shows that the docking station 200 can include the pad dryer blower 242 connected to the housing or canister 202, such as to the rear wall 276. The blower 242 can be a fan, such as an axial or centrifugal fan, and can be in communication with the controller 228. The drying blower 242 can be operable to discharge a drying stream toward the cleaning pad (such as the pad 109), such as when the lift arm 286 lifts the pad tray 108 and the cleaning pad 109.

Figure 15:
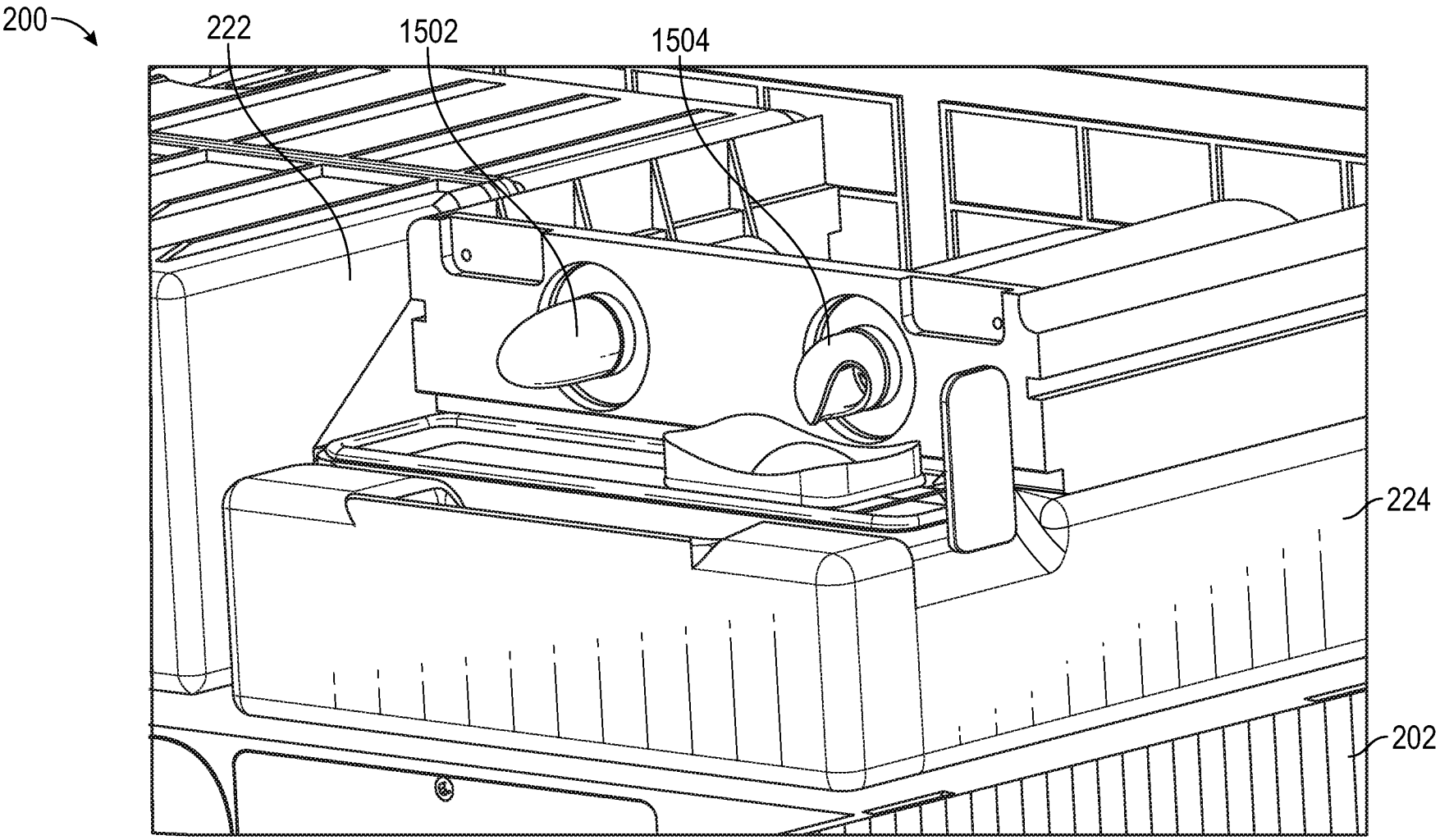
FIG. 15 illustrates an enlarged isometric view of a portion of a docking station.
Figure 16:
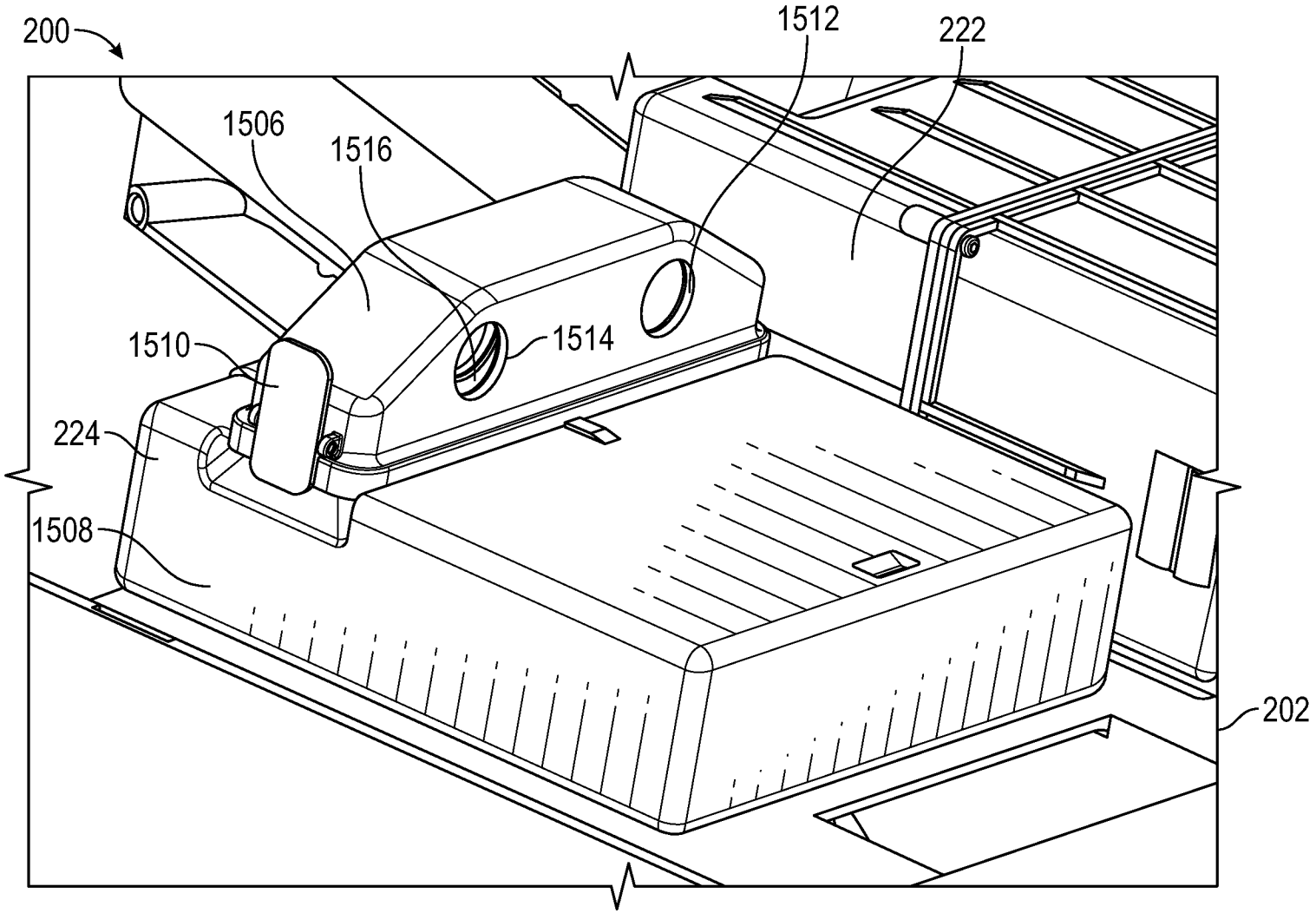
FIG. 16 illustrates an enlarged isometric view of a portion of a docking station.
Figure 17:
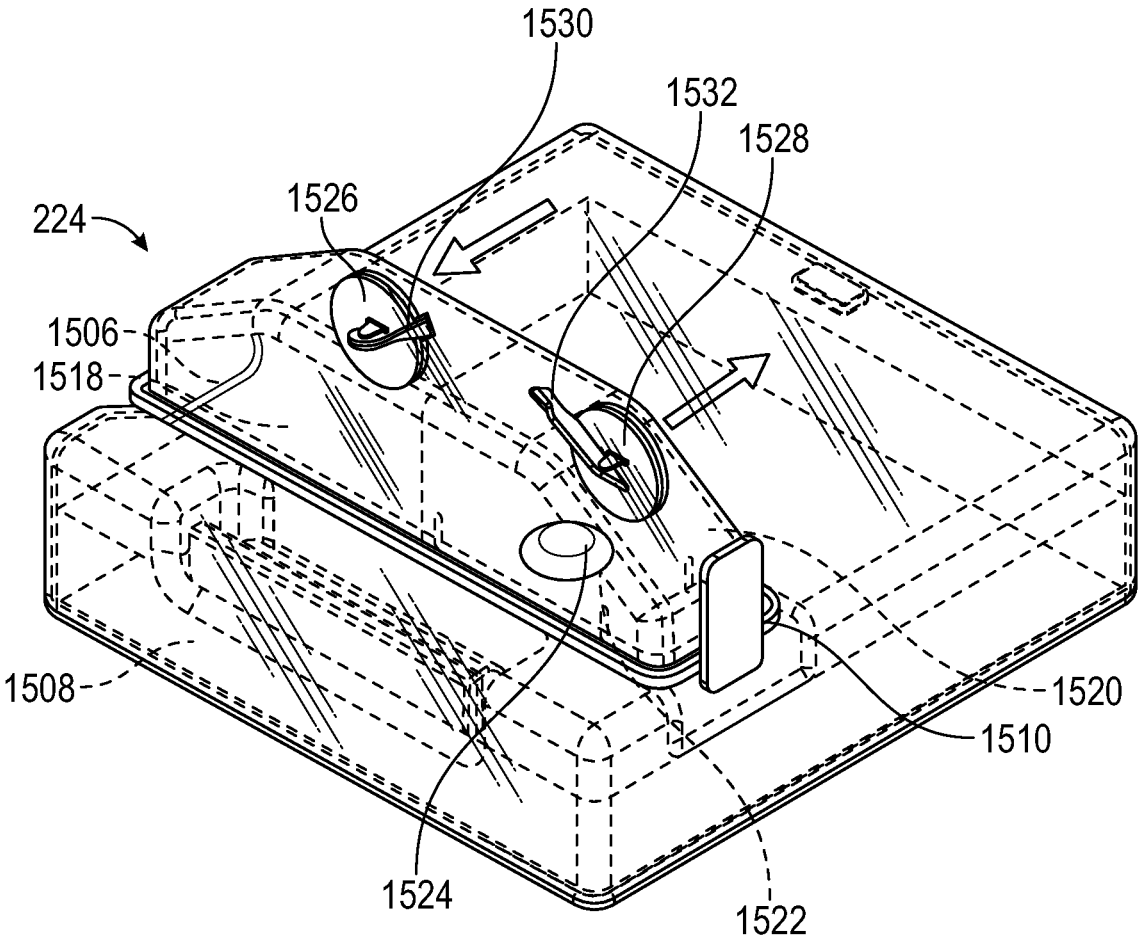
FIG. 17 illustrates an enlarged isometric view of a portion of a docking station.

FIG. 15 illustrates an enlarged isometric view of a portion of the docking station 200. FIG. 16 illustrates an enlarged isometric view of a portion of the docking station 200. FIG. 17 illustrates an enlarged isometric view of a portion of a docking station 200. FIGS. 15-17 are discussed together below. The docking station 200 of FIGS. 15-17 can be consistent with the docking station 200 discussed above. FIGS. 15-17 show additional details of the docking station 200. For example, FIGS. 15-17 show the clean water tank 222 and the dirty water tank 224 in further detail.

More specifically, FIG. 15 shows a portion of the dirty water tank 224 removed to reveal an inlet spout 1502 and an outlet spout 1504 connected to the canister 202. The inlet spout 1502 can interface with the dirty water tank 224 to connect the dirty water tank 224 to the reservoir 234. The outlet spout 1504 can interface with the dirty water tank 224 to connect the dirty water tank 224 to the valve 232 (of FIG. 4) and therefore to the blower 230.

FIG. 16 shows that the dirty water tank 224 can include a header 1506 releasably securable to a base 1508 of the dirty water tank 224. The header 1506 can include a latch 1510 that can be user-operable (or actuatable) to release the header 1506 from the base 1508, such as for cleaning of the base 1508 or the header 1506. The header 1506 can also include openings 1512 and 1514 configured to receive the inlet spout 1502 and the outlet spout 1504 at least partially therein, respectively, to fluidically connect the header 1506 (and the dirty water tank 224) to the reservoir 234 and the blower 230, respectively. The openings 1512 and the opening 1514 can each include a seal or gasket 1516 engageable with the housing around the inlet spout 1502 and the outlet spout 1504 such as to form a seal between the header 1506 and the canister 202 when the dirty water tank 224 is fully inserted into the canister 202.

FIG. 17 shows the header 1506 connected to the base 1508 and shows each in phantom. FIG. 17 also shows that the header 1506 can include an inlet chamber 1518 that can be connected to the inlet opening 1512 and can be open to the bottom to connect the inlet chamber 1518 to the base 1508. The header 1506 can also include an outlet chamber 1520 connected to the outlet opening 1514. The outlet chamber 1520 can be connected to the base 1508 through a round opening 1522.

The dirty water tank 224 can also include a float valve 1524 including a ball that is configured to float to a top portion of the base 1508 as the base 1508 fills with dirty fluid. When the ball 1524 reaches the round opening 1522 (when the base 1508 is full), the ball 1524 can form a seal against the round opening 1522 to help limit liquid from exhausting through the outlet chamber 1520 and the outlet spout 1504, helping to limit ingestion of liquids by the blower 230. Also, closing of the round opening 1522 can cause a relative pressure spike in one or more ducts, which can be detected by the controller 228, allowing the controller 228 to shut off the blower 230 when the dirty water tank 224 is full.

The dirty water tank 224 can also include an inlet valve 1526 and an outlet valve 1528. The inlet valve 1526 can be connected to the header 1506 via a linkage 1530. The inlet valve 1526 can be movable between a closed position (shown in FIG. 17) and an open position. Similarly, the outlet valve 1528 can be connected to the header 1506 via a linkage 1532. The outlet valve 1528 can be movable between a closed position (shown in FIG. 17) and an open position. The inlet valve 1526 can be configured to seal the inlet opening 1512 when the inlet valve 1526 is in the closed position and the outlet valve 1528 can be configured to seal the outlet opening 1514 when the outlet valve 1528 is in the closed position.

When the dirty water tank 224 is inserted into the canister 202, the inlet spout 1502 can engage the inlet valve 1526 and the outlet spout 1504 can engage the outlet valve 1528, to open the inlet valve 1526 and the outlet valve 1528, respectively. When the dirty water tank 224 is removed from the canister 202, the inlet spout 1502 can disengage the inlet valve 1526 and the linkage 1530 can cause the inlet valve 1526 to close, sealing the inlet opening 1512. Similarly, the outlet spout 1504 can disengage the outlet valve 1528 and the linkage 1532 can cause the outlet valve 1528 to close, sealing the outlet opening 1514. In this way, the dirty water tank 224 can be configured to automatically seal when the dirty water tank 224 is removed from the canister 202.

Figure 18:
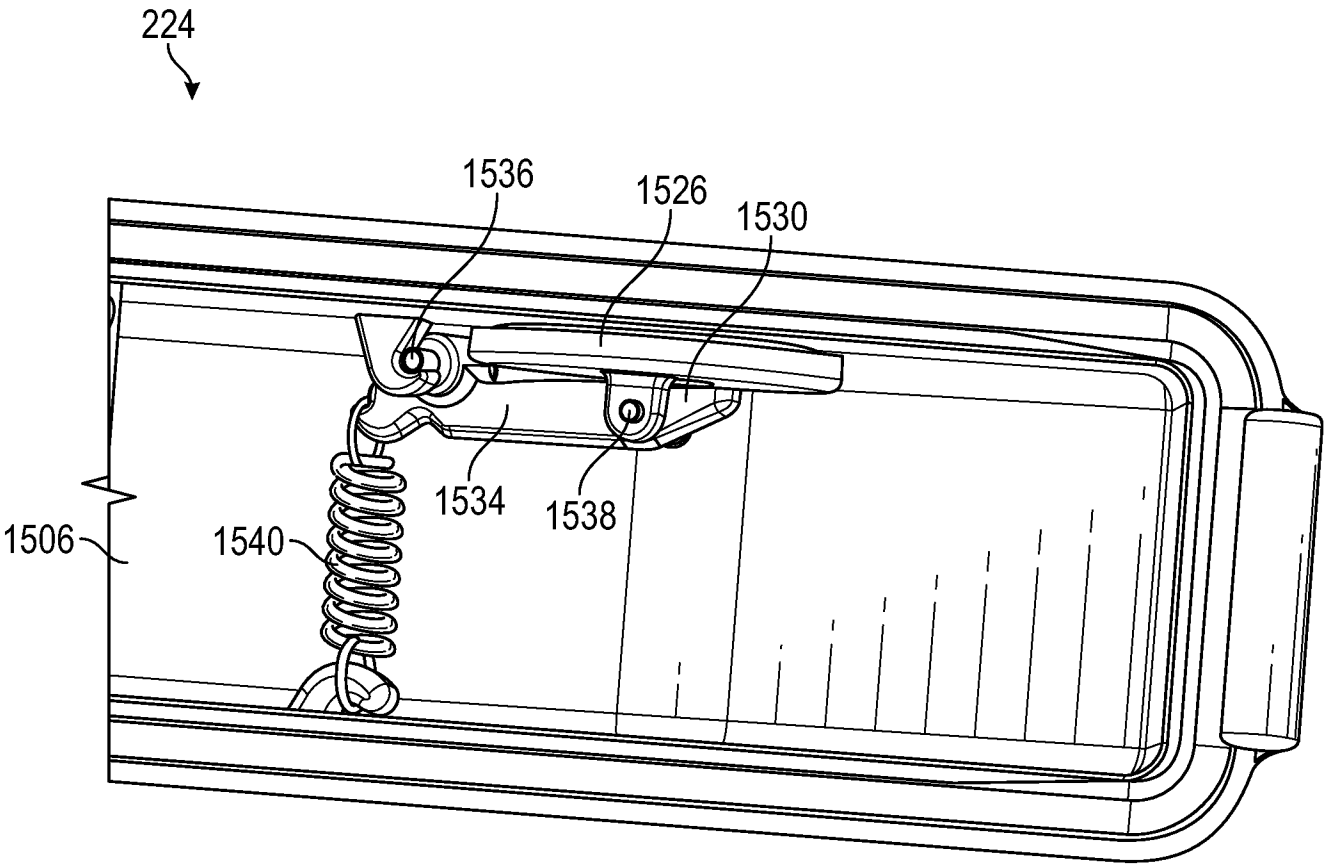
FIG. 18 illustrates an enlarged isometric view of a portion of a docking station.

FIG. 18 illustrates an enlarged isometric view of the dirty water tank 224 of the docking station 200. The dirty water tank 224 can be consistent with the dirty water tank 224 discussed above. FIG. 18 shows additional details of the dirty water tank 224.

More specifically, FIG. 18 shows that the linkage 1530 can include a link arm 1534 connected to the inlet valve 1526 and pivotably connected to the header 1506 by a pivot 1536 (e.g., a pin, bushing, bearing, or the like). The link arm 1534 can also be connected to the inlet valve 1526 by a pivot 1538 (e.g., a pin, bushing, bearing, or the like). The pivots 1536 and 1538 can allow the link arm 1534 to rotate with respect to the header 1506, allowing the inlet valve 1526 to rotate, or move or float (such as up to about five degrees in any direction relative to the arm) about the dual axis pivot, between an open position and a closed position. FIG. 18 also shows that the linkage 1530 can include a biasing element 1540 (e.g., an extension spring) that can bias the link arm 1534 and the inlet valve 1526 to the closed position. The outlet valve 1528 and the linkage 1532 can be similarly configured.

Figure 19:
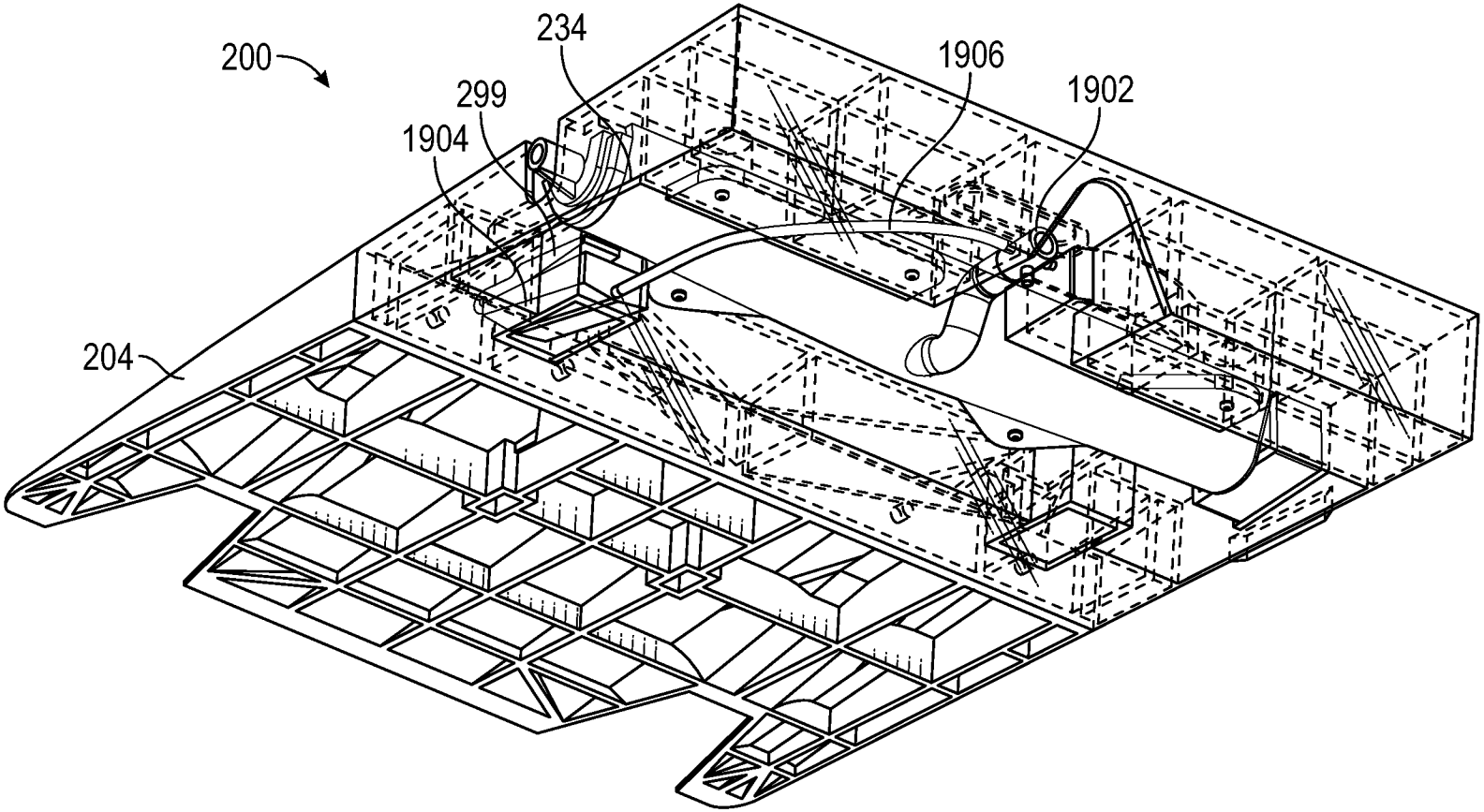
FIG. 19 illustrates an enlarged isometric view of a portion of a docking station.

FIG. 19 illustrates an enlarged isometric view of a portion of the docking station 200. The docking station 200 of FIG. 19 can be consistent with the docking station 200 discussed above. FIG. 19 shows additional details of the docking station 200. For example, FIG. 19 shows that the reservoir 234 can be connected to a port 1902, which can connect to the reservoir 234 at a bottom portion of the reservoir 234, such as to collect as much fluid as possible therefrom. Optionally, the port 1902 can be integrated into the reservoir 234. The port 1902 can optionally include a venturi to help increase flow (and decrease pressure drop) through the port 1902 during evacuation of the reservoir 234.

FIG. 19 also shows that the docking station 200 can include a secondary reservoir 1904, which can be located below the wheel cradles 299. The docking station 200 can include a secondary reservoir under one or more of the wheel cradles or under any other component that can collect water or liquid that may escape the reservoir 234, such as during pad washing operations. The secondary reservoir 1904 can be connected to the port 1902 through a tube 1906, which can be made of one or more polymers and can optionally be flexible. The port 1902 can be connected to the inlet spout 1502 through an additional tube or tubes, allowing the blower 230 to motivate liquid to move from the reservoir 234, the secondary reservoir 1904, or any other reservoirs, into the dirty water tank 224 when the blower 230 is operated to evacuate the liquid.

Figure 20:
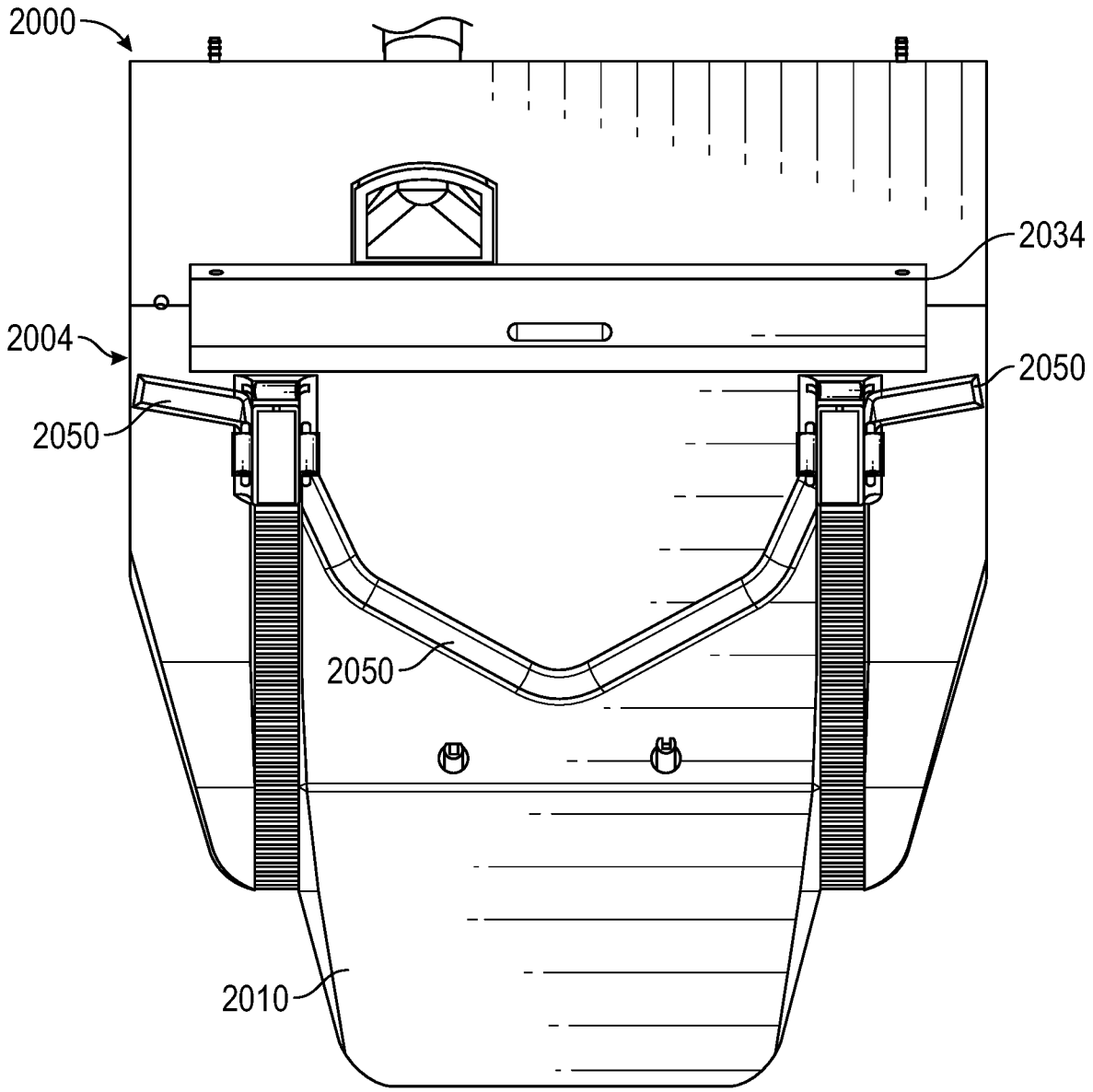
FIG. 20 illustrates an enlarged top view of a portion of a docking station.

FIG. 20 illustrates an enlarged top view of a portion of a docking station 2000. The docking station 2000 of FIG. 20 can be similar to the docking station 200 discussed above, in the docking station 2000 can include a base 2004 and a ramp 2010, among other features. The docking station 2000 can also include a gutter 2050, which can be a recessed channel or gutter in the ramp 2010 configured to collect water or liquid, such as from a reservoir 2034 that may escape during pad cleaning operations. The gutter 2050 can optionally be connected to a blower (e.g., the blower 230) such as via one or more ports (e.g., the port 1902). Optionally, the gutter 2050 can be connected to the reservoir 234. Any of the docking stations discussed above or below can be modified to include the features of the docking station 2000.

Figure 21:
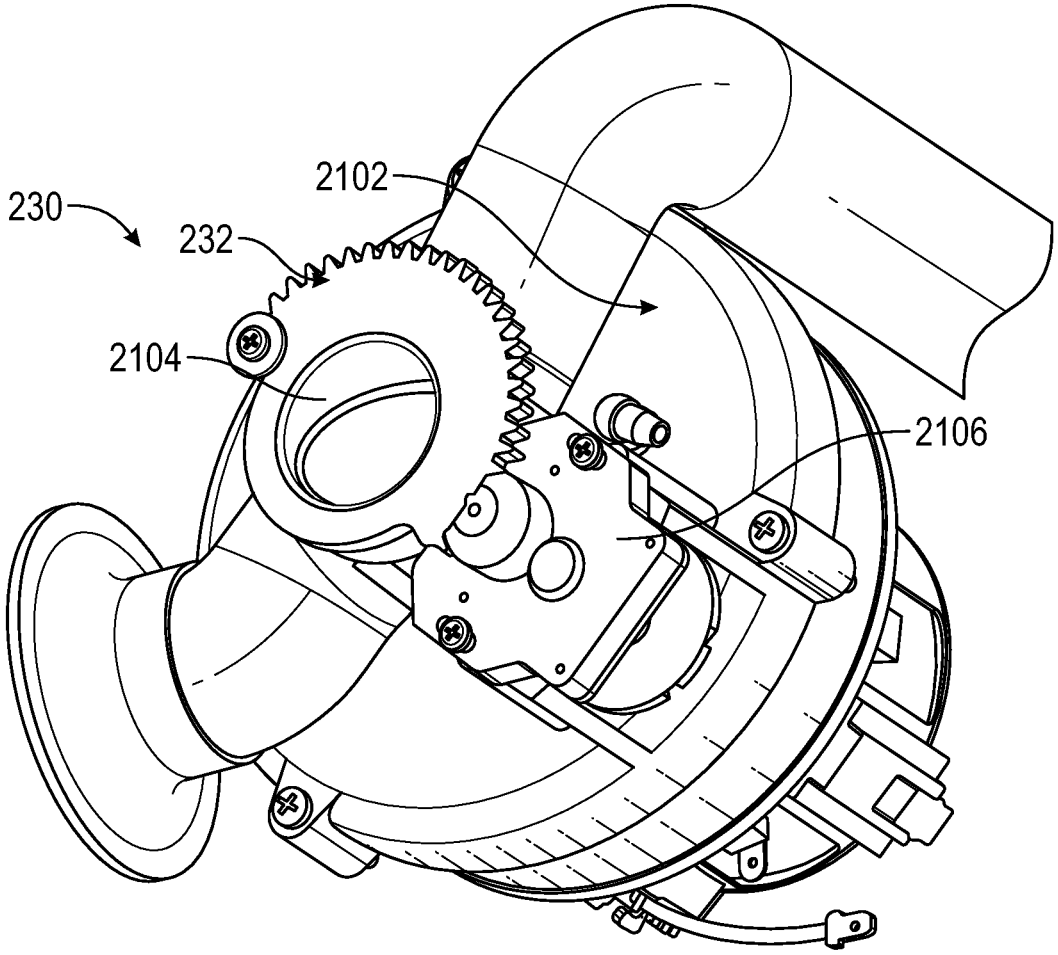
FIG. 21 illustrates an enlarged isometric view of a portion of a docking station.

FIG. 21 illustrates an enlarged isometric view of the blower 230 of the docking station 200. The blower 230 can be consistent with the blower 230 discussed above. FIG. 21 shows additional details of the blower 230. For example, FIG. 21 shows that the blower 230 can be connected to or can include a housing 2102 that can incorporate or support the valve 232. The valve 232 can include a barrel 2104 and an actuator 2106, which can be connected to the controller 228. The actuator 2106 can be operated by the controller 228 to move the barrel 2104 between a debris mode and a liquid mode, where the blower 230 can evacuate debris from the robot 100 into the debris bin 220 in the debris mode and can evacuate liquid from the reservoir 234 into the dirty water tank 224 in the liquid mode.

Figure 22B:
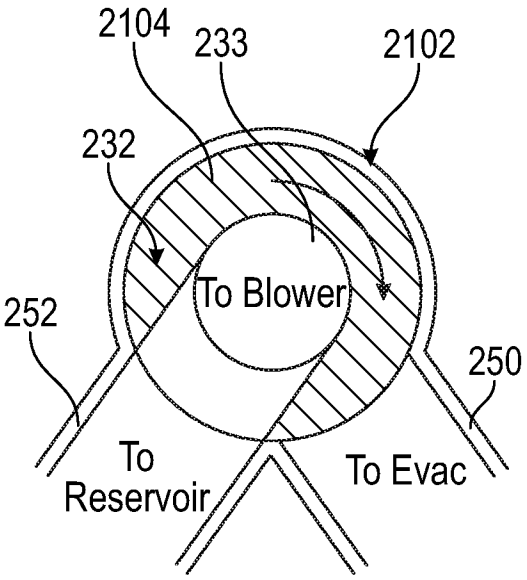
FIG. 22B illustrates a schematic view of a portion of a docking station in a second condition.
Figure 22A:
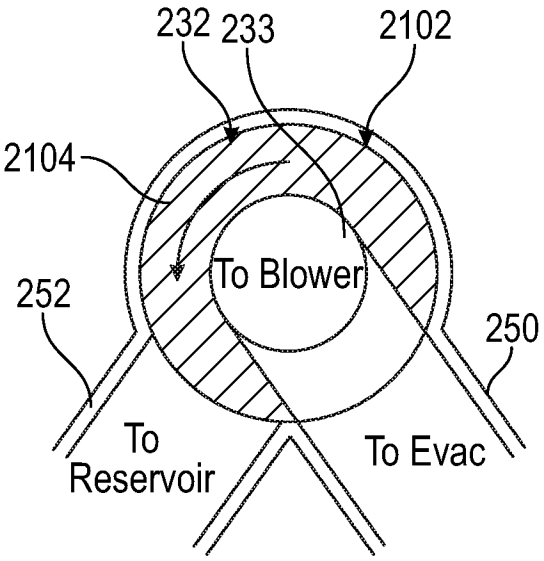
FIG. 22A illustrates a schematic view of a portion of a docking station in a first condition.

FIG. 22A illustrates a schematic view of the valve 232 the docking station 200 in a first condition. FIG. 22B illustrates a schematic view of the valve 232 the docking station 200 in a second condition. FIGS. 22A and 22B are discussed together below. The valve 232 of the docking station 200 can be consistent with the valve 232 discussed above. FIGS. 22A and 22B show, schematically, how the valve 232 can operate. The valve 232 can optionally be a barrel valve.

For example, FIGS. 22A and 22B show that the valve 232 can include the housing 2102, which can support the barrel 2104 at least partially therein, where the barrel 2104 can be movable or rotatable (such as by the actuator 2106) within the housing 2102. The barrel 2104, though described as a barrel, can be any rotating (or moving) and sealing member, such as a disc, ball, flap, gate, or the like. FIGS. 22A and 22B also show that the housing 2102 can be connected to the debris exhaust duct 250 and the fluid exhaust duct 252. The barrel 2104 can be connected to the blower duct 233.

In operation, the actuator 2106 can be operated (e.g., by the controller 228) to rotate the barrel 2104 within the housing 2102. The barrel 2104 can be rotated within the housing 2102 to connect either the blower duct 233 to the fluid exhaust duct 252 or the blower duct 233 to the debris exhaust duct 250.

Figure 23:
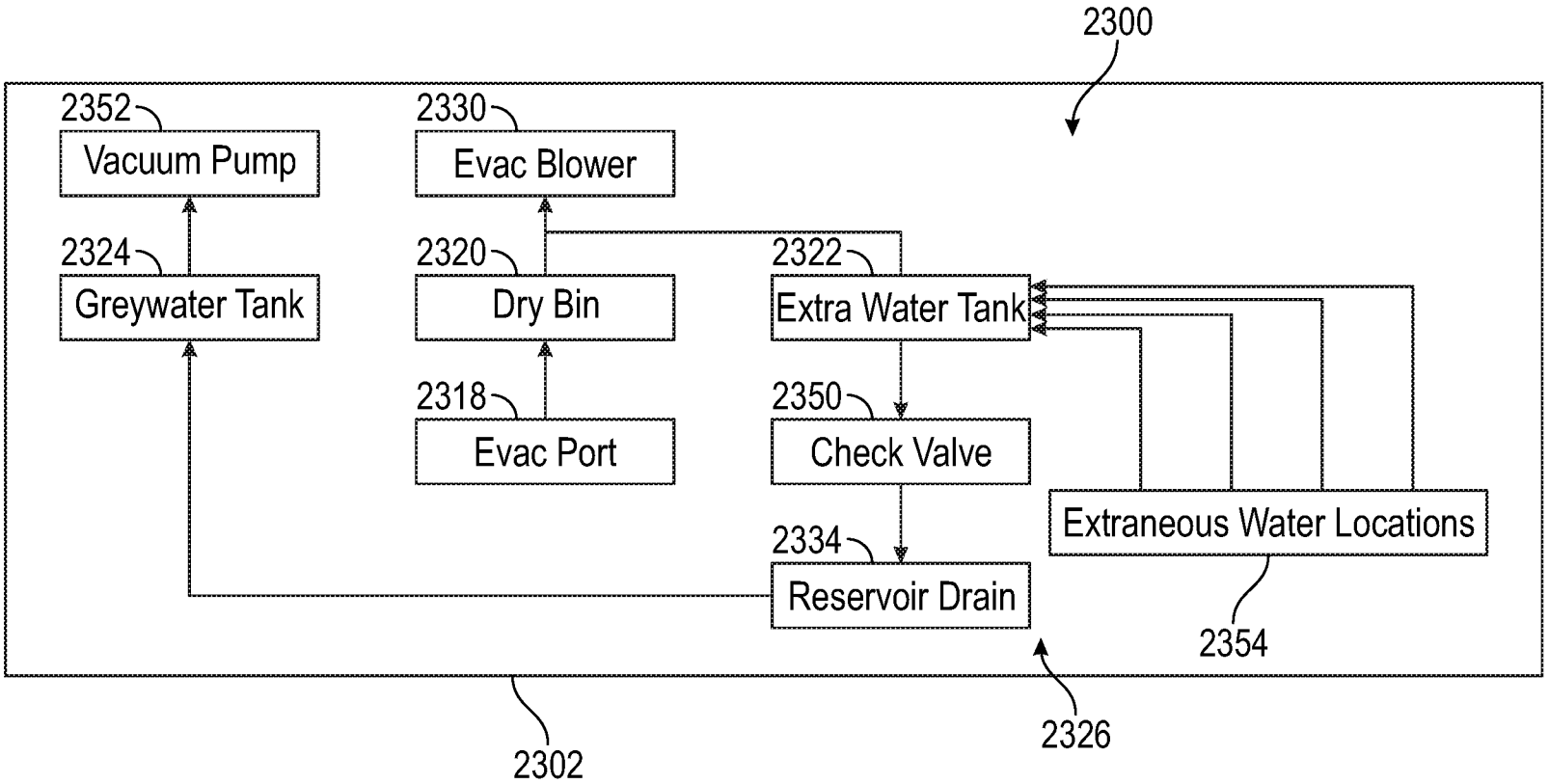
FIG. 23 illustrates a schematic view of a docking station.

FIG. 23 illustrates a schematic view of a docking station 2300. The docking station 2300 can be similar to the docking stations discussed above, such as the docking station 200; the docking station 2300 can include a vacuum pump to drain the reservoir. Any of the docking stations discussed above or below can include the features of the docking station 2300.

More specifically, the docking station 2300 can include a housing 2302 that can be configured to support one or more components of the docking station 2300 therein or thereon. The housing 2302 can include a base and a cannister. The docking station 2300 can also include a pad cleaning system 2326 that can include blower 2330 that can be connected to a debris bin 2320 (such as via one or more ducts) and can be connected to a water tank 2322 (such as via one or more separate ducts). The water tank 2322 can be configured to deliver water to the robot 100 or to the pad cleaning system 2326. Optionally, the 2322 can be an extra or auxiliary water tank, and the docking station 2300 can include a separate water tank (e.g., the clean water tank 222) for filling the reservoir 2334 and the robot 100. The blower 2330 can be a fan, pump, or the like that can be operable to generate an evacuation stream to draw debris out of the mobile cleaning robot 100, through the evacuation port 2318, and into the debris bin 2320, before exhausting the evacuation stream into the environment.

FIG. 23 also shows that the pad cleaning system 2326 can include a reservoir 2334. The reservoir 2334 can be connected to the clean water tank 2322 through one or more water lines (e.g., tubes or pipes) and can be configured to receive clean water therefrom such as to retain the clean water therein for use in cleaning the pad 109 of the robot 100. The docking station 2300 can also include a check valve 2350 located between the water tank 2322 and the reservoir 2334 to limit migration of fluid from the reservoir 2334 back to the water tank 2322.

The docking station 2300 can also include a dirty water tank 2324 that can be connected to the reservoir 2334 and can be connected to a vacuum pump 2352. The vacuum pump 2352 can be a fluid pump (such as a water pump) configured to fluid from the reservoir 2334 to the dirty water tank 2324 for evacuation of the reservoir 2334. The vacuum pump 2352 can be a can be a positive displacement, a centrifugal pump, or an axial pump that can be connected to a controller (e.g., the controller 228) such that the controller 228 can operate the vacuum pump 2352 based on one or more signals.

In operation, the blower 2330 can be operated to evacuate debris from the robot 100 and into the debris bin 2320, such as through the evacuation port 2318. During such operation, the blower 2330 can draw fluid from reservoirs 2354 located in the docking station 2300, such as the gutter 2050 of the docking station 2000. The collected fluid or water can be deposited into the water tank 2322 such that the fluid can be reused in the pad cleaning system 2326 (e.g., for pad cleaning). During evacuation of fluid or water from the reservoirs 2354 into the water tank 2322, the check valve check valve 2350 can help to limit the blower 2330 from drawing fluid out of the reservoir 2334.

Figure 24:
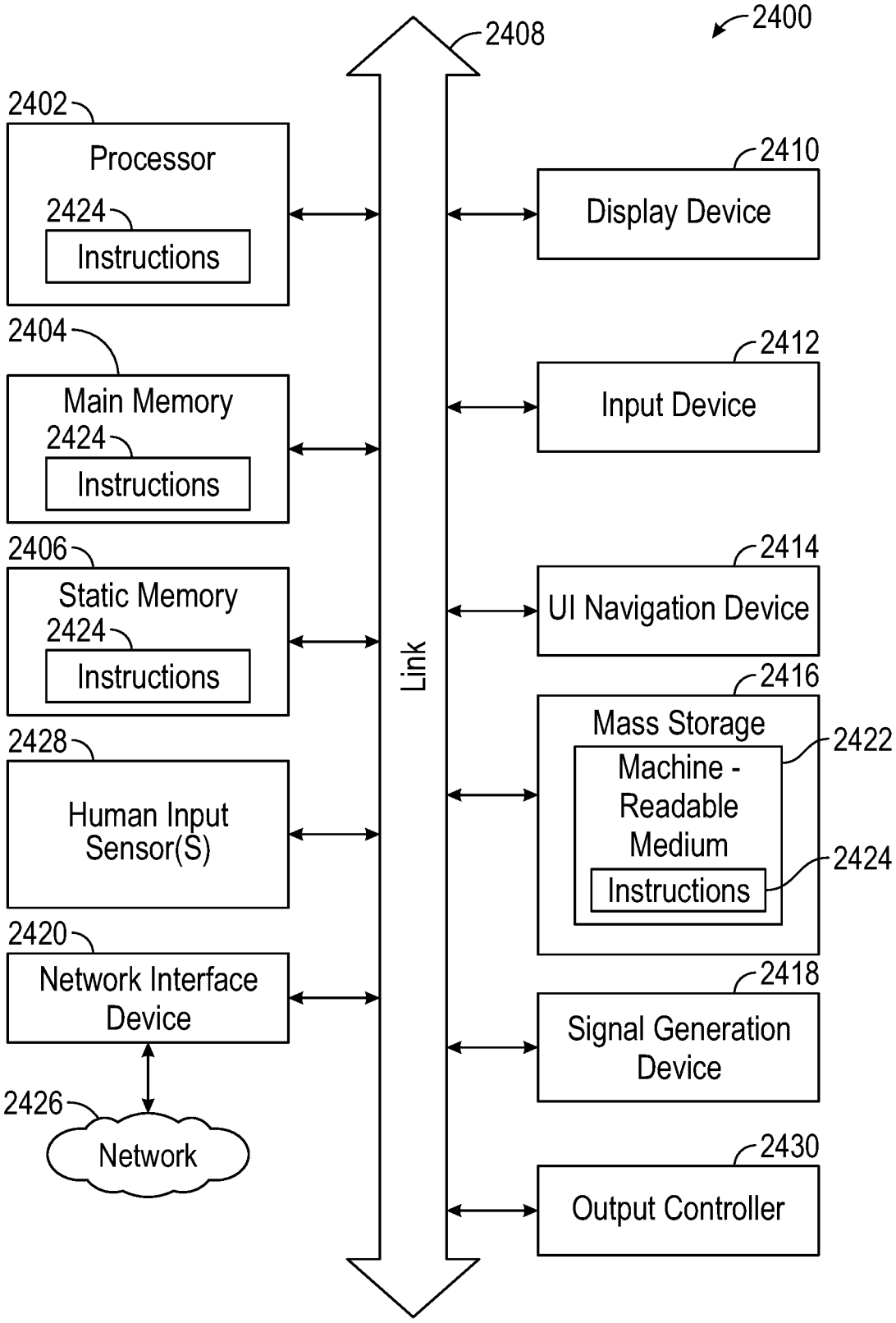
FIG. 24 illustrates a block diagram illustrating an example of a machine upon which one or more embodiments may be implemented.

FIG. 24 illustrates a block diagram of an example machine 2400 upon which any one or more of the techniques (e.g., methodologies) discussed herein can perform. Examples, as described herein, can include, or can operate by, logic or a number of components, or mechanisms in the machine 2400. Circuitry (e.g., processing circuitry) is a collection of circuits implemented in tangible entities of the machine 2400 that include hardware (e.g., simple circuits, gates, logic, etc.). Circuitry membership can be flexible over time. Circuitries include members that can, alone or in combination, perform specified operations when operating. In an example, hardware of the circuitry can be immutably designed to carry out a specific operation (e.g., hardwired).

In an example, the hardware of the circuitry can include variably connected physical components (e.g., execution units, transistors, simple circuits, etc.) including a machine-readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation.

Accordingly, in an example, the machine-readable medium elements are part of the circuitry or are communicatively coupled to the other components of the circuitry when the device is operating. In an example, any of the physical components can be used in more than one member of more than one circuitry. For example, under operation, execution units can be used in a first circuit of a first circuitry at one point in time and reused by a second circuit in the first circuitry, or by a third circuit in a second circuitry at a different time. Additional examples of these components with respect to the machine 2400 follow.

In alternative embodiments, the machine 2400 can operate as a standalone device or can be connected (e.g., networked) to other machines. In a networked deployment, the machine 2400 can operate in the capacity of a server machine, a client machine, or both in server-client network environments. In an example, the machine 2400 can act as a peer machine in peer-to-peer (P2P) (or other distributed) network environment. The machine 2400 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 2400 can include a hardware processor 2402 (e.g., a central processing unit (CPU), a graphics processing unit (GPU), a hardware processor core, or any combination thereof), a main memory 2404, a static memory (e.g., memory or storage for firmware, microcode, a basic-input-output (BIOS), unified extensible firmware interface (UEFI), etc.) 2406, and mass storage 2408 (e.g., hard drive, tape drive, flash storage, or other block devices) some or all of which can communicate with each other via an interlink (e.g., bus) 2430. The machine 2400 can further include a display unit 2410, an alphanumeric input device 2412 (e.g., a keyboard), and a user interface (UI) navigation device 2414 (e.g., a mouse). In an example, the display unit 2410, input device 2412 and UI navigation device 2414 can be a touch screen display. The machine 2400 can additionally include a storage device (e.g., drive unit) 2408, a signal generation device 2418 (e.g., a speaker), a network interface device 2420, and one or more sensors 2416, such as a global positioning system (GPS) sensor, compass, accelerometer, or other sensor. The machine 2400 can include an output controller 2428, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 2402, the main memory 2404, the static memory 2406, or the mass storage 2408 can be, or include, a machine readable medium 2422 on which is stored one or more sets of data structures or instructions 2424 (e.g., software) embodying or utilized by any one or more of the techniques or functions described herein. The instructions 2424 can also reside, completely or at least partially, within any of registers of the processor 2402, the main memory 2404, the static memory 2406, or the mass storage 2408 during execution thereof by the machine 2400. In an example, one or any combination of the hardware processor 2402, the main memory 2404, the static memory 2406, or the mass storage 2408 can constitute the machine-readable media 2422. While the machine readable medium 2422 is illustrated as a single medium, the term "machine readable medium" can include a single medium or multiple media (e.g., a centralized or distributed database, and/or associated caches and servers) configured to store the one or more instructions 2424.

The term "machine readable medium" can include any medium that is capable of storing, encoding, or carrying instructions for execution by the machine 2400 and that cause the machine 2400 to perform any one or more of the techniques of the present disclosure, or that is capable of storing, encoding or carrying data structures used by or associated with such instructions. Non-limiting machine-readable medium examples can include solid-state memories, optical media, magnetic media, and signals (e.g., radio frequency signals, other photon-based signals, sound signals, etc.). In an example, a non-transitory machine-readable medium comprises a machine-readable medium with a plurality of particles having invariant (e.g., rest) mass, and thus are compositions of matter. Accordingly, non-transitory machine-readable media are machine readable media that do not include transitory propagating signals. Specific examples of non-transitory machine-readable media can include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 2424 can be further transmitted or received over a communications network 2426 using a transmission medium via the network interface device 2420 utilizing any one of a number of transfer protocols (e.g., frame relay, internet protocol (IP), transmission control protocol (TCP), user datagram protocol (UDP), hypertext transfer protocol (HTTP), etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 2420 can include one or more physical jacks (e.g., Ethernet, coaxial, or phone jacks) or one or more antennas to connect to the communications network 2426. In an example, the network interface device 2420 can include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 2400, and includes digital or analog communications signals or other intangible medium to facilitate communication of such software. A transmission medium is a machine-readable medium.

NOTES AND EXAMPLES

The following, non-limiting examples, detail certain aspects of the present subject matter to solve the challenges and provide the benefits discussed herein, among others.

Example 1 is a docking station for a mobile cleaning robot, the docking station comprising: a base configured to receive the mobile cleaning robot; a housing connected to the base; and a pad cleaning system connected to the housing, the system comprising: a reservoir configured to retain liquid therein; and an agitator located at least partially within the reservoir, the agitator engageable with a cleaning pad of the mobile cleaning robot.

In Example 2, the subject matter of Example 1 optionally includes a clean tank user-releasably connectable to the housing, the clean tank arranged to store liquid for delivery to the reservoir; and a disposal tank user-releasably connectable to the housing, the disposal tank arranged to receive liquid from the reservoir.

In Example 3, the subject matter of Example 2 optionally includes a debris bin located at least partially within the housing; an evacuation port connected to the base and connected to the debris bin; and a blower connected to the debris bin and operable to generate an evacuation stream to draw debris out of the mobile cleaning robot, through the evacuation port, and into the debris bin.

In Example 4, the subject matter of Example 3 optionally includes a debris exhaust duct connected to the blower and connected to the debris bin; a fluid exhaust duct connected to the blower and connected to the disposal tank; and a blower valve actuatable to direct the evacuation stream generated by the blower through the debris exhaust duct or through the fluid exhaust duct.

In Example 5, the subject matter of Example 4 optionally includes a fluid pipe connected to the reservoir and connected to the disposal tank, the blower operable to draw the evacuation stream through the reservoir, the fluid pipe, and the disposal tank when the blower valve is actuated to direct the evacuation stream through the fluid exhaust duct.

In Example 6, the subject matter of Example 5 optionally includes wherein the blower valve includes a barrel valve.

In Example 7, the subject matter of any one or more of Examples 3-6 optionally include wherein the evacuation port is movable with respect to the base and the housing.

In Example 8, the subject matter of Example 7 optionally includes wherein the blower is operable to move the evacuation port to engage a debris port of the mobile cleaning robot when the mobile robot is docked on the base.

In Example 9, the subject matter of any one or more of Examples 7-8 optionally include wherein the blower is operable to move the evacuation port with respect to the base and the housing to engage a debris port of the mobile cleaning robot when the mobile robot is docked on the base.

In Example 10, the subject matter of Example 9 optionally includes a debris duct connected to the debris port and connected to the debris bin, the debris duct movable with the evacuation port.

In Example 11, the subject matter of Example 10 optionally includes a mount connected to the debris duct and connected to the housing or the base, the mount configured to enable movement of the debris duct with respect to the housing and the base to move the evacuation port with respect to the base and the housing.

In Example 12, the subject matter of any one or more of Examples 2-11 optionally include a fill spout connected to the housing and connected to the clean tank, the fill spout engageable with the robot to deliver clean fluid to the robot; and a fluid valve actuatable to selectively deliver fluid from the clean tank to at least one of the reservoir or the fill spout.

In Example 13, the subject matter of Example 12 optionally includes where the fluid valve includes: a fill armature and a spout armature, the fill armature and the spout armature biased to limit flow of fluid through the fluid valve; and a cam rotatably engageable with the fill armature to do one of (1) allow fluid to flow through the fluid valve and to the fill spout, or (2) engageable with the spout armature to allow fluid to flow through the fluid valve and to the fill spout.

In Example 14, the subject matter of any one or more of Examples 2-13 optionally include a fill spout connected to the housing and fluidically connected to the clean tank and engageable with the mobile robot to deliver liquid to the mobile robot.

In Example 15, the subject matter of Example 14 optionally includes wherein the fill spout is engageable with the robot to rotate with respect to the housing.

In Example 16, the subject matter of any one or more of Examples 2-15 optionally include a header connected to the disposal tank, the header including an inlet valve and an outlet valve.

In Example 17, the subject matter of Example 16 optionally includes wherein the dock includes an inlet spout and an outlet spout engageable with the inlet valve and the outlet valve, respectively, to open the inlet valve and the outlet valve when the header and the disposal tank are secured to the housing.

In Example 18, the subject matter of Example 17 optionally includes wherein the inlet valve and the outlet valve are biased to close when the header and the disposal tank are removed from the housing.

In Example 19, the subject matter of any one or more of Examples 16-18 optionally include wherein the header includes a latch operable to release the header from the disposal tank.

In Example 20, the subject matter of any one or more of Examples 2-19 optionally include wherein the disposal tank includes a float valve operable to close when the disposal tank is filled with liquid.

In Example 21, the subject matter of any one or more of Examples 2-20 optionally include an arm rotatably connected to the housing and engageable with a pad tray of the mobile robot to lift the pad tray and the cleaning pad with respect to a body of the robot.

In Example 22, the subject matter of Example 21 optionally includes a drying blower connected to the housing and operable to discharge a drying stream toward the cleaning pad when the arm lifts the pad tray and the cleaning pad.

In Example 23, the subject matter of any one or more of Examples 2-22 optionally include wherein the base includes a pair of wheel wells configured to receive a corresponding pair of drive wheels of the mobile cleaning robot therein.

In Example 24, the subject matter of Example 23 optionally includes wherein the base includes a pair of rear rollers located at a rear portion of the wheel wells, respectively, the rear rollers engageable with the drive wheels, respectively, to limit movement of the mobile robot toward the housing and to urge the drive wheels into the wheel wells, respectively.

In Example 25, the subject matter of any one or more of Examples 23-24 optionally include wherein the base includes a pair of side rollers located at a lateral portion of the wheel wells, respectively, the side rollers engageable with the drive wheels, respectively, to urge the drive wheels into the wheel wells, respectively.

In Example 26, the subject matter of any one or more of Examples 23-25 optionally include wherein the base includes a pair of charge contact levers connected to charging contacts, respectively, and located at least partially within the wheel wells, respectively, the drive wheels engageable with the charge contact levers, respectively, to move the charging contacts to engage contacts of the mobile robot.

Example 27 is a system to implement of any of Examples 1-27.

Example 28 is a method to implement of any of Examples 1-27.

In Example 29, the apparatuses or method of any one or any combination of Examples 1-28 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A docking station for a mobile cleaning robot, the docking station comprising:

a base configured to receive the mobile cleaning robot;

a housing connected to the base;

a pad cleaning system connected to the housing, the system comprising:

a reservoir configured to retain liquid therein; and an agitator located at least partially within the reservoir, the agitator engageable with a cleaning pad of the mobile cleaning robot;

a clean tank user-releasably connectable to the housing, the clean tank arranged to store liquid for delivery to the reservoir;

a disposal tank user-releasably connectable to the housing, the disposal tank arranged to receive liquid from the reservoir;

a debris bin located at least partially within the housing;

an evacuation port connected to the base and connected to the debris bin, the evacuation port movable with respect to the base and the housing; and a blower connected to the debris bin and operable to generate an evacuation stream to draw debris out of the mobile cleaning robot, through the evacuation port, and into the debris bin, the blower operable to move the evacuation port to engage a debris port of the mobile cleaning robot when the mobile cleaning robot is docked on the base.

2. The docking station of claim 1, further comprising:

a debris exhaust duct connected to the blower and connected to the debris bin;

a fluid exhaust duct connected to the blower and connected to the disposal tank; and a blower valve actuatable to direct the evacuation stream generated by the blower through the debris exhaust duct or through the fluid exhaust duct.

3. The docking station of claim 2, further comprising:

a fluid pipe connected to the reservoir and connected to the disposal tank, the blower operable to draw the evacuation stream through the reservoir, the fluid pipe, and the disposal tank when the blower valve is actuated to direct the evacuation stream through the fluid exhaust duct.

4. The docking station of claim 3, wherein the blower valve includes a barrel valve.

5. The docking station of claim 1, wherein the blower is operable to move the evacuation port with respect to the base and the housing to engage a debris port of the mobile cleaning robot when the mobile cleaning robot is docked on the base.

6. The docking station of claim 5, further comprising:

a debris duct connected to the debris port and connected to the debris bin, the debris duct movable with the evacuation port.

7. The docking station of claim 6, further comprising:

a mount connected to the debris duct and connected to the housing or the base, the mount configured to enable movement of the debris duct with respect to the housing and the base to move the evacuation port with respect to the base and the housing.

8. The docking station of claim 1, wherein the disposal tank includes a float valve operable to close when the disposal tank is filled with liquid.

9. A docking station for a mobile cleaning robot, the docking station comprising:

a base configured to receive the mobile cleaning robot;

a housing connected to the base;

a pad cleaning system connected to the housing, the pad cleaning system comprising:

a reservoir configured to retain liquid therein; and an agitator located at least partially within the reservoir, the agitator engageable with a cleaning pad of the mobile cleaning robot;

a clean tank user-releasably connectable to the housing, the clean tank arranged to store liquid for delivery to the reservoir;

a disposal tank user-releasably connectable to the housing, the disposal tank arranged to receive liquid from the reservoir;

a debris bin located at least partially within the housing;

an evacuation port connected to the base and connected to the debris bin, the evacuation port movable with respect to the base and the housing; and a blower connected to the debris bin and operable to generate an evacuation stream to draw debris out of the mobile cleaning robot, through the evacuation port, and into the debris bin, the blower operable to move the evacuation port with respect to the base and the housing to engage a debris port of the mobile cleaning robot when the mobile cleaning robot is docked on the base.

10. The docking station of claim 9, further comprising:

a debris exhaust duct connected to the blower and connected to the debris bin;

a fluid exhaust duct connected to the blower and connected to the disposal tank; and a blower valve actuatable to direct the evacuation stream generated by the blower through the debris exhaust duct or through the fluid exhaust duct.

11. The docking station of claim 10, further comprising:

a fluid pipe connected to the reservoir and connected to the disposal tank, the blower operable to draw the evacuation stream through the reservoir, the fluid pipe, and the disposal tank when the blower valve is actuated to direct the evacuation stream through the fluid exhaust duct.

12. The docking station of claim 11, wherein the blower valve includes a barrel valve.

13. The docking station of claim 9, further comprising:

a debris duct connected to the debris port and connected to the debris bin, the debris duct movable with the evacuation port.

14. The docking station of claim 13, further comprising:

a mount connected to the debris duct and connected to the housing or the base, the mount configured to enable movement of the debris duct with respect to the housing and the base to move the evacuation port with respect to the base and the housing.

15. The docking station of claim 9, wherein the disposal tank includes a float valve operable to close when the disposal tank is filled with liquid.

* * * * *